US010660382B2

(12) United States Patent
Berzowska et al.

(10) Patent No.: US 10,660,382 B2
(45) Date of Patent: May 26, 2020

(54) APPARATUS, SYSTEMS AND METHODS FOR OPTIMIZING AND MASKING COMPRESSION IN A BIOSENSING GARMENT

(71) Applicant: Honeywell Safety Products USA, Inc., Fort Mill, SC (US)

(72) Inventors: Joanna Berzowska, Montreal (CA); Frederic Chanay, Montreal (CA); Maria Elina Nurkka, Verdun (CA)

(73) Assignee: Honeywell Safety Products USA, Inc., Fort Mill, SC (US)

( * ) Notice: Subject to any disclaimer, the term of this patent is extended or adjusted under 35 U.S.C. 154(b) by 93 days.

(21) Appl. No.: 15/052,263

(22) Filed: Feb. 24, 2016

(65) Prior Publication Data

US 2016/0249698 A1 Sep. 1, 2016

Related U.S. Application Data

(60) Provisional application No. 62/126,134, filed on Feb. 27, 2015.

(51) Int. Cl.

| | |
|---|---|
| ***A41D 13/00*** | (2006.01) |
| ***A41D 13/12*** | (2006.01) |
| ***A41D 1/00*** | (2018.01) |

(52) U.S. Cl.

CPC ..... *A41D 13/0015* (2013.01); *A41D 1/002* (2013.01); *A41D 13/1281* (2013.01); *A41D 2400/38* (2013.01)

(58) Field of Classification Search

CPC .... A41D 31/00; A41D 1/002; A41D 13/1281; A41D 2400/38; A41D 2600/10

(Continued)

(56) References Cited

U.S. PATENT DOCUMENTS 6,047,406 A 4/2000 Dicker et al.
7,636,950 B2 * 12/2009 Melhart ..... A41D 13/0015 2/69

(Continued)

FOREIGN PATENT DOCUMENTS

CA 2877802 A1 1/2014
CN 1652838 A 8/2005

(Continued)

OTHER PUBLICATIONS

Search Report and Written Opinion for International Patent Application No. PCT/CA2016/050207 dated Apr. 27, 2016 (11 pages).

(Continued)

*Primary Examiner* — Alissa L Hoey
(74) *Attorney, Agent, or Firm* — Alston & Bird LLP

(57) ABSTRACT

Embodiments described herein relate generally to devices, systems and methods for optimizing and masking compression in a biosensing garment. The biosensing garment has a first fabric portion configured to be disposed about a circumferential region of a user, the first fabric portion having an inner surface including electrode sensor assembly configured to be placed in contact with the skin of the user, the first fabric portion having a first compression rating; and a second fabric portion extending from the first fabric portion, the second fabric portion having a second compression rating less than the first compression rating.

14 Claims, 10 Drawing Sheets

(58) Field of Classification Search
USPC ..... 2/69
See application file for complete search history.

(56) References Cited

U.S. PATENT DOCUMENTS 7,857,777 B2* 12/2010 Larson ..... A61B 17/1325 600/13
7,895,863 B2 3/2011 Smith et al.
9,125,442 B2* 9/2015 Brown ..... A61F 5/026
9,534,324 B2* 1/2017 Lonati ..... D04B 1/26
2005/0054941 A1* 3/2005 Ting ..... A61B 5/0408 600/529
2006/0117805 A1* 6/2006 Valentine ..... A61B 5/0408 66/171
2006/0211934 A1* 9/2006 Hassonjee ..... A61B 5/0245 600/372
2007/0149093 A1* 6/2007 Lutz ..... A41B 9/00 450/1
2007/0299325 A1* 12/2007 Farrell ..... A61B 5/0002 600/301
2008/0139969 A1* 6/2008 Gough ..... A61B 5/1126 600/595
2008/0295216 A1 12/2008 Nordstrom et al.
2009/0229039 A1* 9/2009 Kuck ..... A41D 13/1254 2/338
2009/0234265 A1* 9/2009 Reid, Jr. ..... A61H 9/0078 602/61
2009/0270708 A1* 10/2009 Shen ..... A61B 5/02438 600/389
2010/0010568 A1* 1/2010 Brown ..... A41D 13/0015 607/48
2010/0088803 A1 4/2010 Orloff
2010/0130903 A1* 5/2010 Rock ..... A61F 13/06 602/62
2010/0251454 A1* 10/2010 Kiernan ..... A41D 1/002 2/69
2010/0299799 A1* 12/2010 Belluye ..... A41D 13/0015 2/69
2011/0004088 A1* 1/2011 Grossman ..... A61B 5/04085 600/382
2011/0214216 A1* 9/2011 Zarabi ..... A41D 27/02 2/69
2011/0302686 A1* 12/2011 Chapuis ..... A41D 13/0015 2/69
2012/0078147 A1* 3/2012 Ogulnick ..... A41D 13/0058 602/2
2012/0174282 A1* 7/2012 Newton ..... A41D 13/0015 2/69
2012/0238910 A1* 9/2012 Nordstrom ..... A61B 5/0006 600/587
2012/0246795 A1* 10/2012 Scheffler ..... A41D 1/002 2/69
2013/0041272 A1* 2/2013 Guillen Arredondo ..... A61B 5/02438 600/509
2014/0082815 A1 3/2014 Harber et al.
2014/0189928 A1* 7/2014 Oleson ..... A61B 5/6823 2/69
2014/0196190 A1* 7/2014 Brown ..... A41C 3/0057 2/69
2014/0259267 A1* 9/2014 Nordstrom ..... A41D 13/1281 2/69
2014/0352023 A1* 12/2014 Mordecai ..... A61B 5/6831 2/69
2015/0018733 A1* 1/2015 Ben-Meir ..... A61F 5/0104 602/6
2015/0119676 A1* 4/2015 Okuda ..... A61B 5/0245 600/388
2015/0119677 A1* 4/2015 Liu ..... A61B 5/04085 600/389
2015/0224011 A1* 8/2015 Scott ..... A61H 7/001 601/84
2015/0250420 A1* 9/2015 Longinotti-Buitoni ..... A61B 5/6804 600/301
2016/0076175 A1* 3/2016 Rock ..... D04B 1/246 66/171
2016/0192716 A1* 7/2016 Lee ..... A41D 1/002 2/422
2016/0213548 A1* 7/2016 John ..... A61H 1/02
2017/0100300 A1* 4/2017 Rapp ..... A41D 1/002
2017/0157430 A1* 6/2017 Cheatham, III ..... A61N 7/00

FOREIGN PATENT DOCUMENTS

CN 102727182 A 10/2012
WO WO 2004006700 A1 * 1/2004 ..... A41D 13/1236
WO WO 2017075703 A1 * 5/2017 ..... H05K 1/038

OTHER PUBLICATIONS

Extended European Search Report dated Jun. 27, 2018 for European Application No. 16754716.5, 7 pages.
State Intellectual Property Office of the People's Republic of China, Office Action dated Oct. 17, 2018, for Chinese Patent Application No. 201680012081.4, 12 pages, China.
Chinese Office Action for Application No. 201680012081.4, dated Sep. 6, 2019, 10 pages.

* cited by examiner

APPARATUS, SYSTEMS AND METHODS FOR OPTIMIZING AND MASKING COMPRESSION IN A BIOSENSING GARMENT

CROSS-REFERENCE TO RELATED APPLICATIONS

This application claims priority to and the benefit of U.S. Provisional Patent Application Ser. No. 62/126,134, filed Feb. 27, 2015 and titled "Apparatus, Systems and Methods for Optimizing and Masking Compression in a Biosensing Garment," the disclosure of which is hereby incorporated by reference in its entirety.

BACKGROUND

The adoption of wearable consumer electronics, or "smart clothing," is currently on the rise. Biosensing garments, a subset of wearable electronics, are designed to interface with a wearer of the garment, and to determine information such as the wearer's heart rate, rate of respiration, activity level, body positioning, etc. Such properties can be measured via a sensor assembly that contacts the wearer's skin and that receive signals from the wearer's body. Through these sensor assemblies, signals are transmitted to one or more sensors and/or microprocessors for transduction, analysis, etc. A drawback of many biosensing garments on the market today, however, is that they do not achieve acceptable signal quality (e.g., the signal is too noisy). Also, many biosensing garments contain bulky electronic hardware, wires, and other components that can make them uncomfortable to the wearer. As such, there is a general need for biosensing garments with improved performance and/or that are more comfortable to wear.

SUMMARY

Embodiments described herein relate generally to devices, systems and methods for optimizing and masking compression in a biosensing garment. In some embodiments, a biosensing garment includes a first fabric portion and a second fabric portion. The first fabric portion has a first compression rating and an inner surface of the first fabric portion includes a sensor assembly configured to be placed in contact with the skin of the user. The second fabric portion extends from the first fabric portion and has a second compression rating that is less than the first compression rating. In some embodiments, a third fabric portion extends from the first fabric portion and has a third compression rating that is less than the first compression rating. In some embodiments, the second compression rating is substantially similar to the third compression rating.

DETAILED DESCRIPTION

Figure 1:
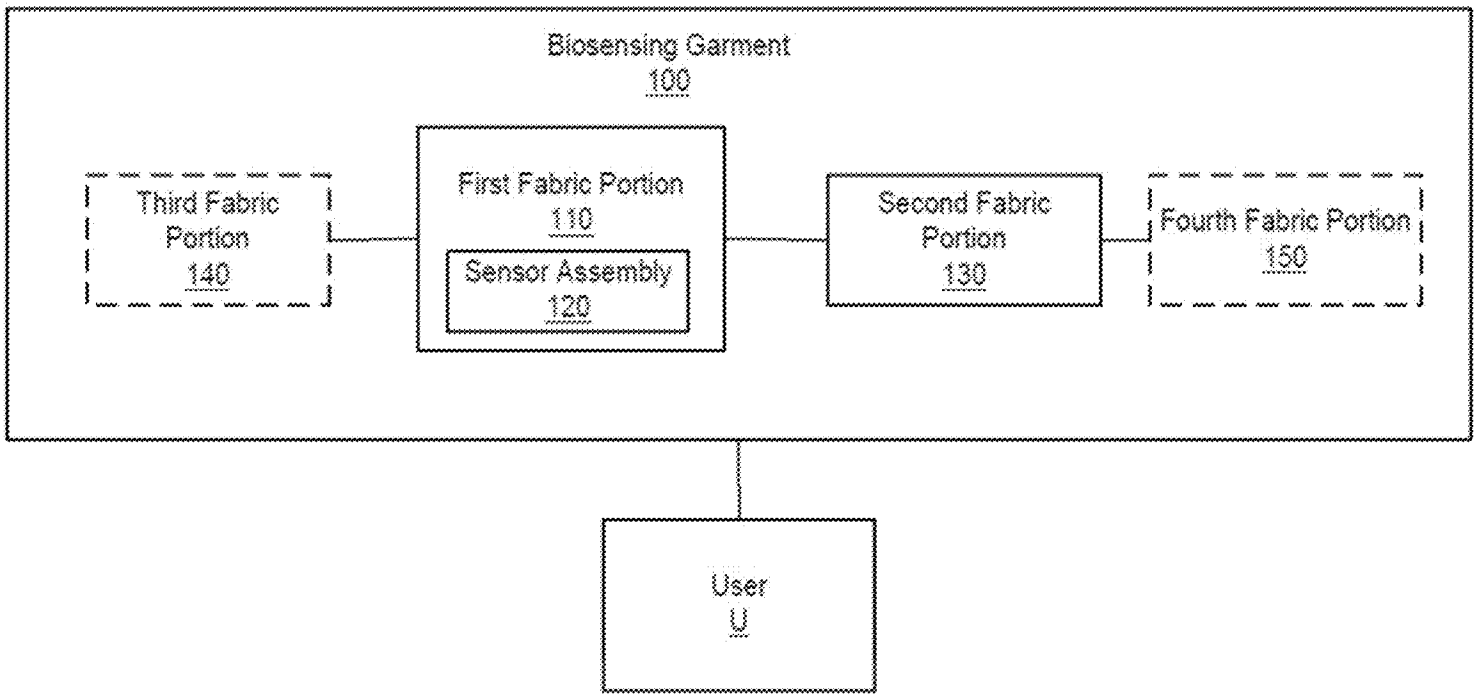
FIG. 1 is a schematic block diagram of a biosensing garment having a sensor assembly configured to be placed in contact with the skin of a user, according to an embodiment.

Embodiments described herein relate generally to devices, systems and methods for optimizing and masking compression in a biosensing garment. In some embodiments, a biosensing garment includes a first fabric portion and a second portion. The first fabric portion has a first compression rating, and an inner surface of the first fabric portion includes a sensor assembly configured to be placed in contact with the skin of the user (for example, disposed about a circumferential region of a user). The second fabric portion extends from the first fabric portion and has a second compression rating that is less than the first compression rating. In some embodiments, a third fabric portion extends from the first fabric portion and has a third compression rating that is less than the first compression rating. In some embodiments, the second compression rating is substantially the same as the third compression rating.

In some embodiments described herein, a biosensing garment is a shirt, a bra, or a tank top that includes a main chest portion configured to apply compression to at least a perimeter of a chest of a user. An upper chest portion is disposed above the main chest portion when worn by the user, and is configured to apply compression to the user in a region above a perimeter of the chest of the user. An upper abdominal portion is disposed below the main chest portion when worn by the user, and is configured to apply compression to at least a perimeter of an upper abdomen of the user. A lower abdominal portion is disposed below the upper abdominal portion when worn by the user, and is configured to apply compression to a region below at least a perimeter of the upper abdomen of the user. A sensor assembly is disposed on an interior surface of at least one of the main chest portion, the upper chest portion, the upper abdominal portion, and the lower abdominal portion, and is configured to make contact with the user's skin. In such embodiments, each of the main chest portion, the upper chest portion, the upper abdominal portion, and the lower abdominal portion is configured to apply a respective amount of compression to the user that varies across the main chest portion, the upper chest portion, the upper abdominal portion, and the lower abdominal portion, for example when worn by an appropriately-sized user.

As described herein, biosensing garments are a subset of "wearable electronics" that are designed to interface with a wearer (also referred to herein as a "user") of the biosensing garment and to capture data and/or determine information about the wearer based upon the body's own output (e.g., movement, electrical signals, chemicals present on the skin, temperature, etc.). This information can be captured in "real time," for example, when the wearer is exercising, sleeping, at rest, or when the wearer wishes to check one or more of the wearer's vital signs (the vital signs including, but not limited to, heart rate, respiration/breathing rate, temperature, blood pressure, etc.). A wearer may also wish to track his or her activity level, body positioning, geographical location, etc., for example, over time to enable viewing of compiled information at a later time. The wearer's physiological properties are often measured via sensors (also referred to herein as "sensor assemblies") of the biosensing garment (e.g., sensors can be embedded therein, integrally-formed therewith, applied thereto, and/or attached thereto). These sensors are often designed to contact the wearer's skin and to receive signals (e.g., electrical, acoustic, temperature, and/or chemical data, and/or the like) from the wearer's body and/or to convert physical phenomena into electrical signals. Through these sensors, signals can be transmitted to one or more sensors and/or microprocessors for transduction, analysis, etc. For example, in some embodiments, the sensors can be substantially similar to or the same as the sensors and/or electrodes included in U.S. Patent Publication No. 2014/0343390, titled "Textile Blank With Seamless Knitted Electrode," ("the '390 Publication"), the disclosure of which is incorporated herein by reference in its entirety.

There are a number of drawbacks of biosensing garments on the market today. For example, many biosensing garments do not achieve good signal quality because of noise (e.g., the signal-to-noise ratio is below a desirable or optimal level). Such noise can originate, for example, as a result of the environment (lack of moisture, low salinity, etc.) and/or due to motion of the wearer (e.g., friction or breaking contact with the skin of the wearer). These environmental and motion factors can result in the degradation and/or disruption of the contact between the sensor assembly and the wearer's skin, and thus the transmission and/or fidelity of the transmitted signal(s). As a result, downstream signal processing may be significantly more complicated and/or take longer to process, and/or the data may not correlate well with the physiological parameters that the device is designed to measure. In addition, many biosensing garments (for example, wearable therapeutic devices) fail to function properly unless they are sufficiently "tight," particularly in the vicinity of the sensor assembly. To ensure proper functioning, many biosensing garment manufacturers include straps, cinches, and/or other mechanical implements that can be adjusted until the proper degree of "tightness" is achieved. In other cases, biosensing garments are designed and/or manufactured to have a tight fit in the location(s) where the sensor assembly is located, while the remainder of the garment is much looser. For example, starting with a design for a traditional (i.e., non-"smart") garment having a "standard" fit, a plan is made for the introduction of electronic components into one or more locations on the garment, and only those regions of the garment are correspondingly modified so that they will fit more snugly, while the remainder of the garment design remains unchanged. Such designs can lead to unwanted shifting of the garment during activities such as running. Additionally, some biosensing garments require a user to "pre-wet" the garment (e.g., with plain water) if immediate measurements are desired and the user is not yet sweating. One example of a heart rate monitoring chest strap requiring pre-wetting in the absence of sweat is the chest strap accessory for the XBR55 Fitness Bike sold by Spirit Fitness. The Owner's Manual for the XBR55 Fitness Bike instructs users that sweat is the best conductor to measure "very minute heart beat electrical signals," but that plain water can also be used to "pre-wet" the electrodes. Specifically, it is suggested that the user pre-wet two ribbed oval areas on the reverse side of the belt, and on both sides of a transmitter that is positioned in the middle of the user's torso, facing away from the user's chest.

Embodiments of a biosensing garment described herein provide several advantages over known biosensing garments on the market today such as: improved continuity and consistency of signal, reduced noise (and, correspondingly, higher signal-to-noise ratio), a lower propensity for sensing regions of the garment to shift, improved overall comfort and wearability, and reduced irritation and/or injury due to friction or cutting of the edges of compressive regions into a wearer's skin.

Although in some instances increasing the compression rating (e.g., "tightness") of a biosensing garment can improve signal quality and other design considerations, it can also have some of the negative consequences described above, including, for example, friction-induced noise and discomfort to the wearer. In other words, when only certain portions of a garment are tight fitting the wearer feels the discontinuity in "compression" of the garment (e.g., an abrupt change between a "tight" region and a "loose" region), and he correspondingly perceives that it is uncomfortable to wear. This perceived low level of comfort on the part of the wearer may stem, in part, from objective physical discomfort, and/or in part due to the psychological and/or neuropsychological implications of the biosensing garment's intrusion of the wearer's personal space (e.g., peripersonal space). There is therefore a tradeoff between a design of the biosensing garment that has the best electrical or "functional" performance, and a design that attains the highest level of comfort to the wearer.

In some embodiments, the present disclosure seeks to strike a balance between these two categories of consideration, in order to obtain an optimized biosensing garment that is both adequately functional as well as comfortable. Specifically, the present disclosure is directed to optimizing the compression levels used for sensing purposes (i.e., in the vicinity of the sensor assembly and/or associated electronics, such that good contact and good signal quality are achieved) while also optimizing the distribution of compression across the garment so that the wearer is comfortable. The more comfortable the biosensing garment is to wear, the more likely a user is to wear it, thus improving its marketability as well as market adoption, consumer satisfaction, patient compliance (e.g., in medical applications), etc.

Biosensing garments according to the present disclosure have applicability in a wide of range of applications and industries. For example, biosensing garments of the present disclosure may include athletic apparel (e.g., shirts, jerseys, vests, jackets, pants, shorts, sports bras, brassieres, swimsuits, hats, helmets, goggles, socks, shoes, footwear, headsets, watches, bracelets, underwear, athletic supporters, gloves, collars, neckbands, headbands, visors, scarves, mittens, arm sleeves, arm bands, leg sleeves, leg bands, head bands, waist bands, chest plates, tights, and/or the like). Embodiments of the present disclosure may also be used in medical applications (e.g., shirts, pants, hats, vests, bracelets, watches, undergarments, diapers, hospital gowns, bandages, smocks, girdles, blankets, and/or the like). Embodiments of the present disclosure may also be used in body re-contouring applications for aesthetic purposes.

Embodiments described herein seek to optimize the "comfort" (and/or "wearability") of a biosensing garment, as perceived by a wearer. The "comfort level" of a given biosensing garment, as generally perceived by a wearer, may depend on one or more of the following factors: absolute compression level (e.g., as measured in mmHg), relative compression level (e.g., with respect to one or more adjacent regions of the garment having a different compression level), rate of change of compression level (e.g., compression drop-off, compression variation, and/or compression gradient), number of compression regions on the garment, discrete vs. gradient nature of the compression variation, method of achieving the compression (e.g., circular knitting, application of elastomers to the surface of the textile, weave pattern, and/or choice of fiber or other raw material. In some embodiments, the "comfort level" and/or "optimization" of the biosensing garment of the present disclosure may (in addition to, or as an alternative to, the compression level engineering described above) also be customizable to a particular user. For example, the perceived "comfort level" of a biosensing garment may depend upon one or more of the following: size of the wearer, proportionality and/or body shape of the wearer, age of the wearer, gender of the wearer, medical condition(s) of the wearer (e.g., pregnancy, hypertension, circulation problems, respiratory problems, superficial wounds or injuries, claustrophobia, etc.), sensitivity of the wearer, type of activity for which the garment is designed, the activity level of the target wearer (e.g., sedentary, moderate activity, high-impact aerobic activity, etc.), the wearer's lung capacity, the wearer's propensity to sweat (e.g., wearers having hyperhidrosis vs. those that do not), and/or the wearer's personal preference.

In designing garments of the disclosure for optimal compression distribution, a number of factors should be taken into account, including the sizing of the garment as it relates to the body shape and size of the intended wearer. Size charts may be developed for specific body types, shapes and sizes. Differences in body type, shape and/or size (e.g., wide shoulders or "V-shape," deviations in waistline, muscle mass, fat mass, body mass index (BMI), abnormal body shapes, and/or the like) each may cause variation in the degree of fit of the garment. The height of a wearer can also affect the fit of a garment, for example in that a "chest" region of a biosensing shirt will be positioned higher on the chest of a tall wearer (when worn) than it would on a shorter wearer (when worn), for the same biosensing shirt.

Referring now to FIG. 1, a biosensing garment 100 includes a first fabric portion 110 having a first compression rating and an inner surface that includes at least a portion of a sensor assembly 120 configured to be placed in contact with the skin of a user U. The sensor assembly 120 can include sensors (not shown), disposed on the inner surface of the biosensing garment, and configured to be disposed in contact with a particular portion of the skin of the user when the biosensing garment 100 is worn by the user U. For example, in some embodiments, the biosensing garment 100 can be a shirt and the sensors can include electrodes (not shown) positioned substantially within an inner circumferential region of the biosensing garment 100 such that, when worn, the electrodes (not shown) contact the chest and back portions of the user. In other embodiments, the biosensing garment 100 can be a bra or a tank top and the sensors can include one or more electrodes (not shown) positioned substantially within an inner circumferential region of the biosensing garment 100 such that, when worn, the one or more electrodes contact the body of the user. Such a configuration is suitable, for example, in electrocardiography (ECG) applications to monitor a user's heart rate. For example, electrodes can be configured to detect electrical activity of the user's heart, in the form of electrical impulses (or "signals") caused by the polarization and depolarization of cardiac tissue (i.e., electrocardiography, or "EKG" or "ECG"). These signals are then transmitted, via electrical interconnect (e.g., wires, metallized films, and/or conductive fibers, which may be on a surface of the biosensing shirt, embedded therein, or both) to one or more "controllers" or "processing modules" (not shown) that are embedded within and/or connectable (e.g., via connectors) to the shirt (thereby also forming part of the sensor assembly), for further analysis, calculation of the user's heart rate, and/or wireless transmission. In some embodiments, the electrodes can be continuously and seamlessly knitted in a fabric layer of the biosensing garment 100, for example as described in the '390 Publication incorporated by reference above.

In some embodiments, the sensor assembly 120 includes one or more biosensing electrodes, one or more sensing elements/components, interconnect, control circuitry, and/or the like can be configured to make contact with a wearer's skin and is electrically coupled to an interconnect (not shown) such as, for example, wires, metal traces, and/or conductive fibers. The interconnect may be protected by an adjacent, electrically-insulating layer. The interconnect electrically connects the sensing elements to one or more connectors for coupling to a "controller" or "processing module," configured to analyze the electrical signals received from the sensing elements and correlate the signals to one or more physiological parameters of the user. In some embodiments, the processing module may include a transmitter configured to wirelessly communicate raw and/or processed sensor data to a remote location for display and/or further processing, said remote location including, for example, a wristwatch, smartphone (e.g., via an app), PDA, PC, GPS network, "the cloud," etc. The processing module may also include one or more of: a memory, a processor (e.g., a microprocessor, a microcontroller, an ASIC chip, an ARM chip, and/or a programmable logic controller (PLC)), a transimpedance amplifier circuit configured to convert current to an amplified voltage, an analog to digital converter (ADC) configured to digitize a received voltage, a filtering circuit (e.g., low-pass, high-pass, band pass, and/or combination thereof). Where the processing module comprises a processor, the processor may be programmed to execute algorithms, e.g., to perform signal processing.

As described herein, the sensor assembly 120 of the biosensing garment 100 can be positioned substantially within a circumferential region of a user U such as, for example, the circumferential region of at least a portion of the wearer's chest as well as his or her upper back. Such positioning can be desirable, for example, in embodiments where signals from the heart are measured (e.g., in electrocardiography, or "EKG" or "ECG" applications), since such signals are traditionally "transthoracic" (across the thorax or chest). Such configurations are also useful when measuring the electrical activity of chest and/or back muscles. In some embodiments contemplated by the present disclosure, the sensor assembly 120 can be positioned in other regions of a wearer's anatomy, for example including (but not limited to) the thigh, ankle, waist, neck, arm, ankle, head, feet, wrist, finger, palm, etc. In some embodiments, positioning of the sensor assembly in one or more of the aforementioned regions can be favorable over other locations with regard to signal quality, reliability, and/or relevance, depending upon what is being measured. For example, in some embodiments, a thigh strap may include the sensor assembly, for purposes of measuring activity of the wearer's quadriceps and hamstring muscles. In some embodiments, the sensor assembly 120 can include other types of sensors including, for example, electrical sensors (e.g., bio-potential, breath rhythm, sweat conductivity, etc.), electrochemical sensors (e.g., pH, ion, etc.), organic sensors (e.g., protein detection, etc.), electrocardiogram (ECG or EKG) sensors, heart rate sensors, breathing rate sensors, temperature sensors and/or other physical biosensors, chemical sensors, acoustic wave sensors, IR sensors, UV sensors, humidity sensors, moisture sensors, ion sensors (e.g., capable of detecting the presence of chloride, sodium, potassium, calcium, magnesium, etc.), motion sensors, accelerometers, glucose detectors, pressure sensors, and/or the like. In some embodiments, the sensor assembly 120 may be configured to perform skin conductance measurements in order, for example, to determine an Electrodermal Response (EDR) and/or an Electrodermal Level (EDL). The sensor assembly 120 can include more than one sensing elements/components, interconnects, control circuitry, and/or the like.

The biosensing garment 100 also includes a second fabric portion 130 extending from the first fabric portion 110 and having a second compression rating that is less than the first compression rating. For example, in an embodiment where the biosensing garment 100 is a shirt and the first fabric portion 110 is configured to be positioned about the chest of the user, the second fabric portion 130 can extend downward from the first fabric portion 110 such that it is configured to be positioned about an abdominal region of the user. The second compression rating of the second fabric portion 130 may be selected such that a "comfort level" of the biosensing garment 100, as perceived by a user U, is increased. The comfort level may be improved, for example, by a less abrupt change in compression between adjacent fabric portions of the biosensing garment 100 due to the selection of the first and second compression ratings. The less abrupt change can result in a lower perceived intrusion of a user's U personal space (e.g., peripersonal space), or a reduced irritation and/or injury from friction or cutting of the edges of compressive regions into a wearer's skin. The comfort level, as described above, may also depend upon one or more of the following: size of the wearer, proportionality and/or body shape of the wearer, age of the wearer, gender of the wearer, medical condition(s) of the wearer (e.g., pregnancy, hypertension, circulation problems, respiratory problems, superficial wounds or injuries, claustrophobia, etc.), sensitivity of the wearer, type of activity for which the garment is designed, the activity level of the target wearer (e.g., sedentary, moderate activity, high-impact aerobic activity, etc.), the wearer's lung capacity, the wearer's propensity to sweat (e.g., wearers having hyperhidrosis vs. those that do not), and/or the wearer's personal preference.

In some embodiments, the biosensing garment 100 can include a third fabric portion 140 extending from the first fabric portion 110 and having a third compression rating that is less than the first compression rating. For example, in an embodiment where the biosensing garment 100 is a shirt and the first fabric portion 110 is configured to be positioned about the chest of the user, the third fabric portion 140 can extend upward from the first fabric portion 110 such that it is configured to be positioned about an upper chest portion of the user U. In some embodiments, the third compression rating can be substantially similar to the second compression rating so that the user U "feels" a uniform compression gradient extending away from the first fabric portion 110.

In some embodiments, the biosensing garment 100 can include a fourth fabric portion 150 extending from the second fabric portion 130 and having a fourth compression rating that is less than the second compression rating. For example, in an embodiment where the biosensing garment 100 is a shirt and the second fabric portion 130 is configured to be positioned about the abdominal region of the user, the fourth fabric portion 150 can extend downward from the second fabric portion 130 such that it is configured to be positioned about a waist region of the user U. In some embodiments, the fourth compression rating can be less than the second compression rating so that the user U "feels" a "gradual" compression gradient extending away from the first fabric portion 110, through the second fabric portion 130, and to the fourth fabric portion 150. In some embodiments, the fourth compression rating can be substantially less than the second compression rating so that the user U can more easily put the shirt on and take the shirt off. Said another way, since the bottom portion of a shirt has to fit over the shoulders of the user U when the shirt is being put on and taken off, the bottom portion can be designed to be relatively looser to increase usability of the shirt without sacrificing the compression "masking" or the signal quality of the biosensing garment 100. In further embodiments (not shown), any number of additional fabric portions may be included in the biosensing garment 100 to achieve the desired "masking" result, as disclosed herein. Techniques for knitting biosensing garments of the disclosure can be found, by way of example, in the '390 Publication incorporated by reference above. In some embodiments of the disclosure, including the biosensing shirt of FIGS. 1A and 1B, the first fabric, second, and third fabric portions are substantially tubular and seamlessly formed.

As described herein, the sensor assembly 120 of the biosensing garment 100 can be positioned substantially within a circumferential region of a user U such as, for example, the circumferential region of at least a portion of the wearer's chest as well as his or her upper back. Such positioning can be desirable, for example, in embodiments where signals from the heart are measured (e.g., in electrocardiography, or "EKG" or "ECG" applications), since such signals are traditionally "transthoracic" (across the thorax or chest). Such configurations are also useful when measuring the electrical activity of chest and/or back muscles. In some embodiments contemplated by the present disclosure, the sensor assembly 120 can be positioned in other regions of a wearer's anatomy, for example including (but not limited to) the thigh, ankle, waist, neck, arm, ankle, head, feet, wrist, finger, palm, etc. In some embodiments, positioning of the sensor assembly in one or more of the aforementioned regions can be favorable over other locations with regard to signal quality, reliability, and/or relevance, depending upon what is being measured. For example, in some embodiments, a thigh strap may include the sensor assembly, for purposes of measuring activity of the wearer's quadriceps and hamstring muscles. In some embodiments, the sensor assembly 120 occupies a single fabric portion (e.g., the first fabric portion 110). In other embodiments, the sensor assembly 120 occupies multiple fabric portions of the biosensing garment 100 (e.g., two or more of the first fabric portion 110, the second fabric portion 130, the third fabric portion 140, the fourth fabric portion 150, and/or any number of additional fabric portions). For example, a sensor of the sensor assembly 120 may be positioned in the first fabric portion 110, the sensor being electrically coupled to wiring or "interconnect" (also part of sensor assembly 120) extending from the first fabric portion 110 through the second fabric portion 130 to the fourth fabric portion, where the wiring or "interconnect" are electrically coupled to one or more connectors (also part of sensor assembly 120) which may subsequently be used for making connection to a controller or "processing module."

In some embodiments, a biosensing garment 100 is configured to "mask" (i.e., to obscure or render less perceivable) the presence of the sensor assembly 120, such that the user U is unaware or less aware of its presence (e.g., so that the garment is more comfortable). This masking may be accomplished by fabricating the garment such that it exerts a substantially uniform amount of compression to the wearer across all portions of the garment, thereby making it difficult or impossible for the user to "feel" the edge(s) of the sensor assembly. In some embodiments, masking may be accomplished by fabricating the garment such that it exerts a maximum amount of compression in the first fabric portion 110 including at least a portion of the sensor assembly 120, and the regions of the garment immediately adjacent to the first fabric portion 110 (e.g., the second fabric portion 130 and optionally the third fabric portion 140) are configured to exert an amount of compression that is slightly lower than the compression exerted by the first fabric portion 110 (i.e., for the same user U). In still further embodiments, masking may be accomplished by fabricating the garment such that it exerts a maximum amount of compression in the first fabric portion 110 including at least a portion of the sensor assembly, and the regions of the garment immediately adjacent to the first region (e.g., the second fabric portion 130 and optionally the third fabric portion 140) are configured to exert an amount of compression that varies along one or more axes extending away from the first region.

The variation in compression may, for example, include a linear reduction (from the maximum value, immediately adjacent to the first region, to a different, lower value, at a predetermined distance away from the first region). In other embodiments, the variation in compression may be in the form of a "compression gradient." As used herein, a compression gradient refers to a progressive and/or gradual (i.e., "degressive") change of one or more properties from a first location to a second location of the biosensing garment (e.g., from a proximal end to a distal end of the biosensing garment). The change may be an increase or a decrease. In other embodiments, the reduction may be non-linear, stepwise, or any other suitable pattern that eliminates any abrupt transition from the first region, having the maximum compression value, to any other region of the garment. The amount of compression (i.e., the compression "rating") may vary: (1) substantially linearly, both from the electrode assembly upward (e.g., from the chest upward, in the direction of the neck of the user), as well as from the electrode assembly down (e.g., from the chest downward, in the direction of a lower hem of the garment); (2) non-linearly in any direction (e.g., laterally, longitudinally, or radially); (3) linearly in any direction; and/or (4) by a certain pre-determined percentage or absolute value. In some embodiments, the compression rating varies in different ways in different directions in a single biosensing garment. For example, the compression rating may gradually decrease from the chest in the direction of the shoulders along a first distance, then steeply drop off to a minimum value at the shoulders, and then gradually increase along the sleeves of the biosensing garment, moving from the shoulder downward to the wrists of the user U. In some embodiments, a combination of the above compression variation schemes is used in the manufacture of a single biosensing garment.

In some embodiments, garment compression can be measured with a pneumatic measuring device (also "compression tool") that is equipped with a flat probe into which 2 cc of air are inflated before each measurement. The probe is placed between the skin and the garment at different locations on the body, and compression values and/or changes (e.g., when a wearer is breathing) for various body positions and movements can thus be determined. In some embodiments, the compression measurement is made under an electrocardiography (ECG) electrode pad. Compression values or "ratings" may be measured in mmHg. Compression ratings may correspond to one or more "comfort levels" as perceived by a wearer. For example, if the chest area is noticeably tighter to a user than the rest of the garment, the comfort rating is lower than when the overall garment has tighter compression that 'masks' the feel of tightness of the band. The signal quality of a biosensing element within garments of varying compression configurations may also be measured and analyzed. For example, a correlation between compression ratings and quality of a transduced signal may be determined. This correlation may be used to calculate an optimum range of compression ratings for a particular garment that gives an optimum signal quality yet remains comfortable to wear.

Methods of imparting levels of compression (compression "ratings") and/or gradients to biosensing garments of the disclosure include (but are not limited to): circular or "tubular" knitting (e.g., on a cylindrical knitting machine), flat knitting (e.g., flat bed knitting) and/or other compressive stitching, cut-and-sew techniques, the application of flexible materials such as elastomers (e.g., silicone) to the garment (e.g., in patterns such as bands, either before or after the garment has been formed), the use of compressive yarns, straps, materials, zippers and/or other fasteners, the use of bladder systems inflatable by gaseous or liquid means, the selection of thread denier (e.g., of a laid-in thread or core material), the choice of one or more materials (e.g., the combination of core-spun yarn with a laid-in elastomeric thread, the combination of two or more yarn types, etc.), adjusting the tension (e.g., pre-tension) of one or more integrated threads, variation of a stitch size, variation of loop tightness, variation of knit type (e.g., compressive stitch, overlap stitch, moss type stitch, non-run stitch), variation of cross-sectional area (e.g., of a tubular knit), the use of elastics, the use of reinforcing materials (e.g., yarn), and/or the like. Embodiments of the present disclosure may incorporate one or more different techniques for imparting the disclosed compression ratings to a single biosensing garment. In some embodiments, compression ratings are inherent to a base textile used in the fabrication of a biosensing garment. In some embodiments, compression ratings are achieved at least in part by modifying a base textile by one or more of the techniques herein described.

Figure 2B:
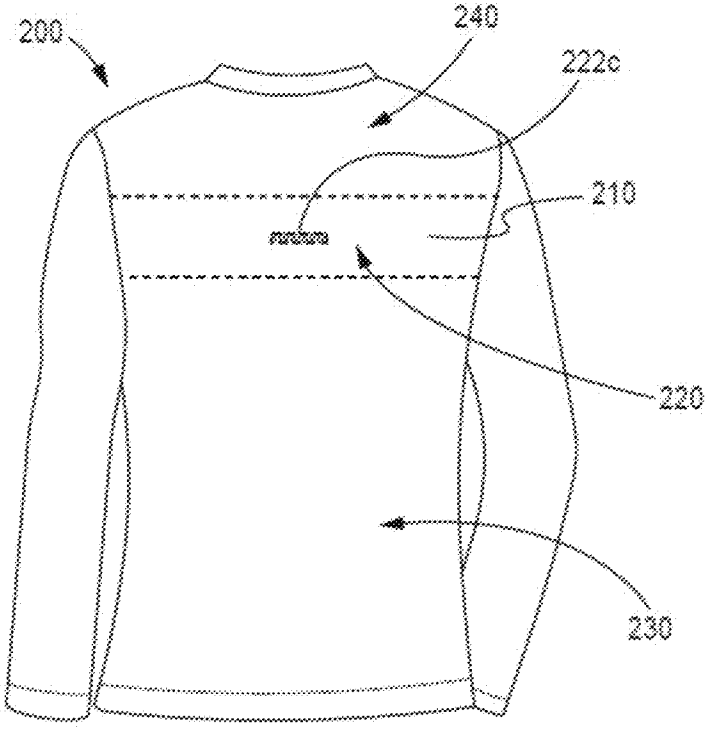
FIG. 2B shows a back schematic plan view of a biosensing shirt having a sensor assembly disposed on an interior of the shirt, according to an embodiment.
Figure 2A:
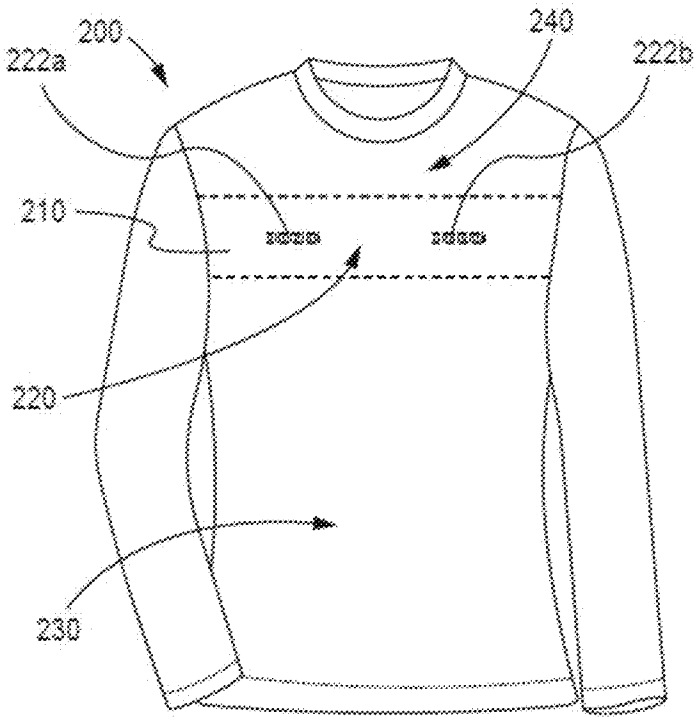
FIG. 2A shows a front schematic plan view.

Turning now to FIGS. 2A and 2B (corresponding to front and rear views, respectively), in some embodiments of the present disclosure a biosensing shirt 200 includes a first fabric portion 210 configured to be disposed about a chest region of a user U. The first fabric portion 210 has a first compression rating and an inner surface that includes at least a portion of a sensor assembly 220 configured to be placed in contact with the skin of the user U. The sensor assembly 220 includes electrodes 222*a*, 222*b* and 222*c*, each disposed on the inner surface of the biosensing garment and positioned substantially within an inner circumferential region of the biosensing shirt 200 such that, when worn, the electrodes

222*a*, 222*b* and 222*c* contact the chest and back regions of the user's body. As described above, such a configuration is suitable, for example, in ECG applications to monitor a user's heart rate. The biosensing shirt 200 includes a second fabric portion 230, configured to be positioned about the abdominal region of the user, extending from the first fabric portion 210. The second fabric portion 230 has a second compression rating that is less than the first compression rating. The biosensing shirt 200 also includes a third fabric portion 240 extending upward (towards the neck) from the first fabric portion 210 that has a third compression rating that is less than the first compression rating. Although biosensing shirt 200 is described herein as having first, second and third fabric portions whose compression ratings differ, in some embodiments, the compression ratings of two or more fabric portions (e.g., adjacent fabric portions) of the biosensing shirt 200 are substantially the same or are only slightly lower than the first compression rating. This is desirable since, in some embodiments, relatively high compression adjacent to a region of highest compression is necessary for positional/structural stability, user comfort, and/or preservation of signal quality.

Figure 3B:
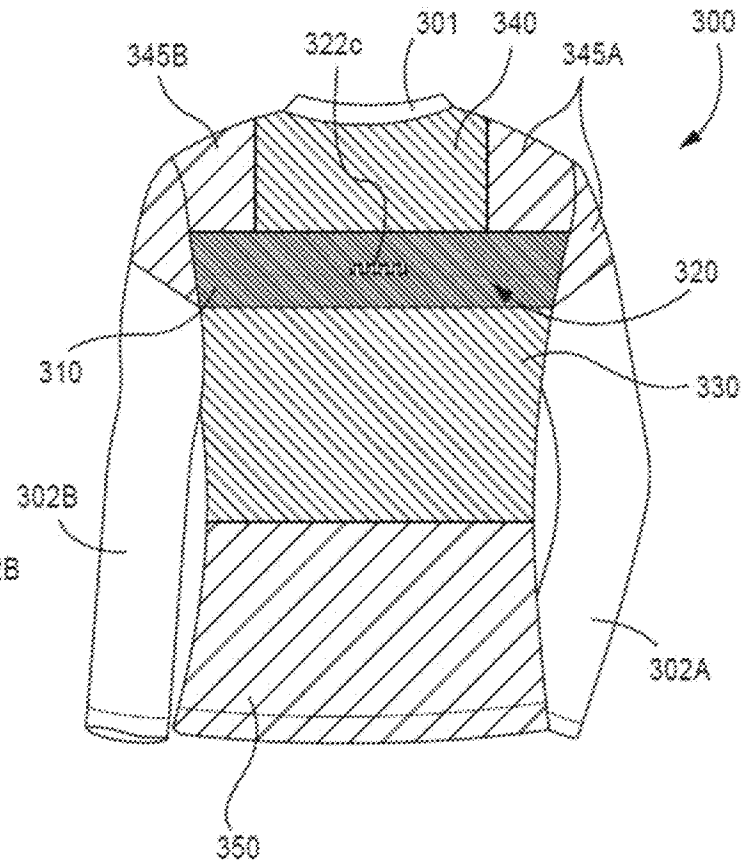
FIG. 3B shows a back schematic plan view of a biosensing shirt having a plurality of compression regions, according to an embodiment.
Figure 3A:
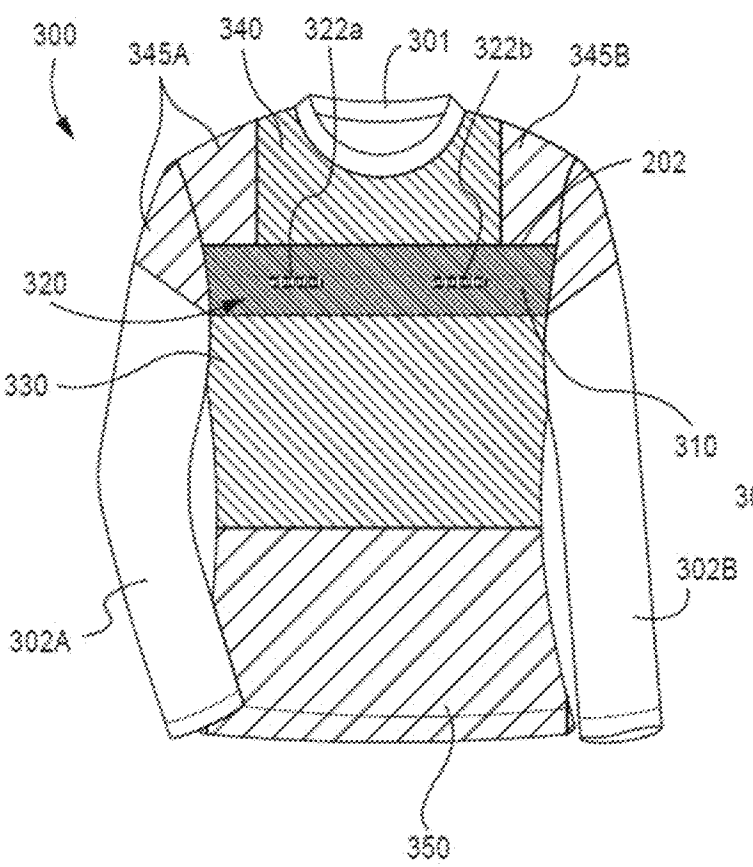
FIG. 3A shows a front schematic plan view.

Turning now to FIGS. 3A and 3B (corresponding to front and rear views, respectively), in some embodiments of the present disclosure a biosensing shirt 300 includes a first fabric portion 310 configured to be disposed about a chest region of a user U. The first fabric portion 310 has a first compression rating and an inner surface that includes at least a portion of a sensor assembly 320 configured to be placed in contact with the skin of the user U. The sensor assembly 320 includes electrodes 322*a*, 322*b* and 322*c*, each disposed on the inner surface of the biosensing garment and positioned substantially within an inner circumferential region of the biosensing shirt 300 such that, when worn, the electrodes 322*a*, 322*b* and 322*c* contact the chest and back regions of the user's body. As described above, such a configuration is suitable, for example, in ECG applications to monitor a user's heart rate. The biosensing shirt 300 includes a second fabric portion 330, configured to be positioned about the abdominal region of the user, extending from the first fabric portion 310. The second fabric portion 330 has a second compression rating that is less than the first compression rating. The biosensing shirt 300 also includes a third fabric portion 340 extending upward (towards the neck) from the first fabric portion 310 that has a third compression rating that is less than the first compression rating. The biosensing shirt 300 includes a fourth fabric portion 350 extending downward from the second fabric portion 330 such that it is configured to be positioned about a waist region of the user U. The fourth fabric portion 350 has a fourth compression rating that is less than the second compression rating. As shown in FIGS. 3A and 3B, fabric portions 310, 330, 340 and 350 present a "stepwise" distribution of discrete regions adjacent to one another (e.g., integrally formed within the same garment), each having a substantially uniform compression rating.

As indicated by the differences in shading throughout FIGS. 3A and 3B, the biosensing shirt 300 comprises a plurality of discrete regions, each having a different absolute compression level (e.g., in mmHg) (i.e., regions having the same type of shading have substantially the same average compression rating across their respective regions). For example, fabric portion 302A, corresponding with a right sleeve of biosensing shirt 300, fabric portion 302B, corresponding with a left sleeve of biosensing shirt 300, and fabric portion 301, corresponding with a collar of biosensing shirt 300, have a "lowest" absolute compression rating. Fabric portions 345A and 345B, corresponding with right and left shoulders, respectively, of the biosensing shirt 300, and the fourth fabric portion 350, corresponding with the waist or lower abdominal region of the biosensing shirt 300, all have a "low" absolute compression rating that is higher than the "lowest" absolute compression rating. Third fabric portion 340, extending from the upper chest to the upper back, and second fabric portion 330, including part of the lower chest and/or the upper abdominal region, have a "moderate" absolute compression rating that is higher than the "low" absolute compression rating. First fabric portion 310, wrapping around the circumference of the user's U chest and including electrodes 322*a*, 322*b* and 322*c*, has a "high" absolute compression rating that is higher than the "moderate" absolute compression rating. Accordingly, the transition of compression value from the first fabric portion 310 to other fabric portions of the biosensing shirt 300 is "stepwise," for example as follows: (1) moving downwards from the midline of the chest (i.e., from the center of first fabric portion 310) towards the bottom hemline of the biosensing shirt 300, the compression rating changes from the first ("high" absolute) compression rating, to the second ("moderate" absolute) compression rating, to the fourth ("low") absolute compression rating; (2) moving laterally from the midline of the chest (i.e., from the center of first fabric portion 310) towards either one of the sleeves, the compression rating changes from the first ("high" absolute) compression rating, to the fourth ("low" absolute) compression rating, to the "lowest" absolute compression rating; and (3) moving upward from the midline of the chest (i.e., from the center of first fabric portion 310) towards the neck/collar region 301, the compression rating changes from the first ("high" absolute) compression rating, to the third ("moderate" absolute) compression rating, to the "lowest" absolute compression rating. In some embodiments, the sequencing of compression ratings among the multiple fabric portions of the biosensing shirt 300 (or other type of garment) varies from the sequencing hereinbefore described. In other words, any combination and sequencing of compression ratings among the multiple fabric portions of the biosensing shirt 300 (or other type of garment) is contemplated by the present disclosure.

Figure 4B:
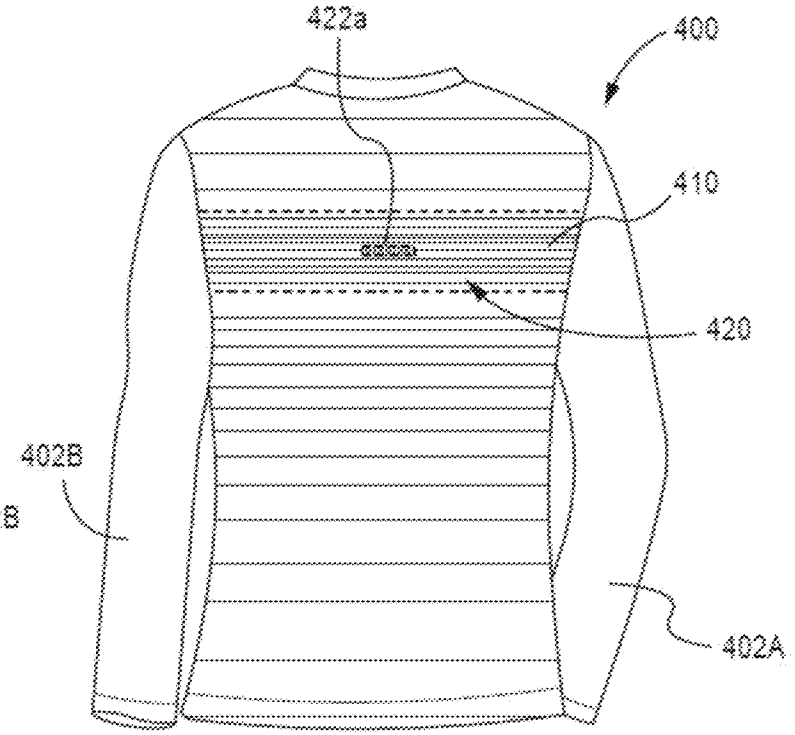
FIG. 4B shows a back schematic plan view of a biosensing shirt having a compression gradient along a vertical axis of the shirt, according to an embodiment.
Figure 4A:
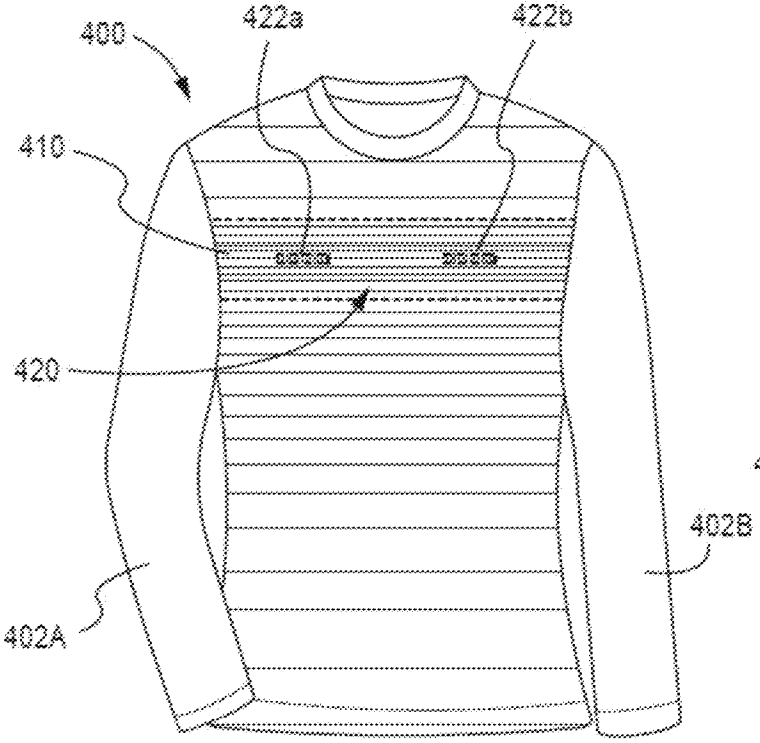
FIG. 4A shows a front schematic plan view.

Turning now to FIGS. 4A and 4B (corresponding to front and rear views, respectively), in some embodiments of the present disclosure a biosensing shirt 400 includes a fabric portion 410 configured to be disposed about a torso of a user U, the fabric portion 410 comprising a gradient (e.g., a linear gradient) compression rating distribution and an inner surface that includes at least a portion of a sensor assembly 420 configured to be placed in contact with the skin of a user U. The sensor assembly 420 includes electrodes 422*a*, 422*b* and 422*c*, each disposed on the inner surface of the biosensing shirt 400 and positioned substantially within an inner circumferential region of the biosensing shirt 400 such that, when worn, the electrodes 422*a*, 422*b* and 422*c* contact the chest and back regions of the user's body. A circumferential region of fabric portion 410 that includes electrodes 422*a* and 422*b* (and, optionally, electrode 422*c*) is configured to have a "peak" compression rating. As described above, such a configuration is suitable, for example, in ECG applications to monitor a user's heart rate. The differences in horizontal line spacing shown in FIGS. 4A and 4B illustrate differences in how the compression rating varies across the garment. Closely spaced horizontal lines represent a steeper "slope" or a greater rate of change per unit length of the relative compression rating, while lines spaced farther apart represent gentler slopes, or a more gradual rate of change per unit length of relative compression rating. As such, FIGS. 4A and 4B depict a relatively steep fall-off in compression rating moving vertically away (both upwards and downwards along the vertical axis of the biosensing shirt 400) from the region having the "peak" compression rating, followed by more gradual tapers, in both directions, of the compression rating (i.e., to minimum values at the neck and lower hemline portions of the biosensing shirt 400). Although the compression rating variation of biosensing shirt 400 is shown in FIGS. 4A and 4B as varying substantially linearly and substantially along a vertical axis, in some embodiments, the compression rating may vary nonlinearly and/or along multiple axes (e.g., vertical, horizontal, and/or oblique axes). For example, in some embodiments, the compression rating of the shirt may vary radially outwardly from a region of relatively high compression. In such embodiments, the variation of compression rating may be symmetric or asymmetric. In some embodiments, additional fabric portions may be joined with, or formed seamlessly with and adjacent to, fabric portion 410 of biosensing shirt 400. Such additional fabric portions may have compression ratings that are substantially uniform, or they may instead comprise a gradient compression rating distribution (which may be linear, non-linear, and/or any other pattern as described herein). For example, sleeve fabric portions 402A and 402B (representing the right sleeve and the left sleeve, respectively) may be configured to have a relatively low compression rating at their top portions (i.e., near/at the "shoulders") and may have a maximum compression rating at a location along the upper arm (e.g., where friction can occur between a user's U arm and a corresponding/adjacent part of the user's U upper torso) and/or in the vicinity of the wrist. Similarly, in embodiments of the disclosure comprising other types of garments, such as pants, fabric portions of said garments may be configured to apply relatively high compression in the vicinity of major muscles, joints, and/or key sensing areas of the user's U anatomy. Additionally, some fabric portions of garments according to the disclosure may be configured to apply relatively low compression in locations that cause discomfort to the user U, and/or where constriction of bloodflow of the user U is to be avoided, and/or (for example, in the case of customization), where portions of the user's U anatomy may be injured.

Figure 5B:
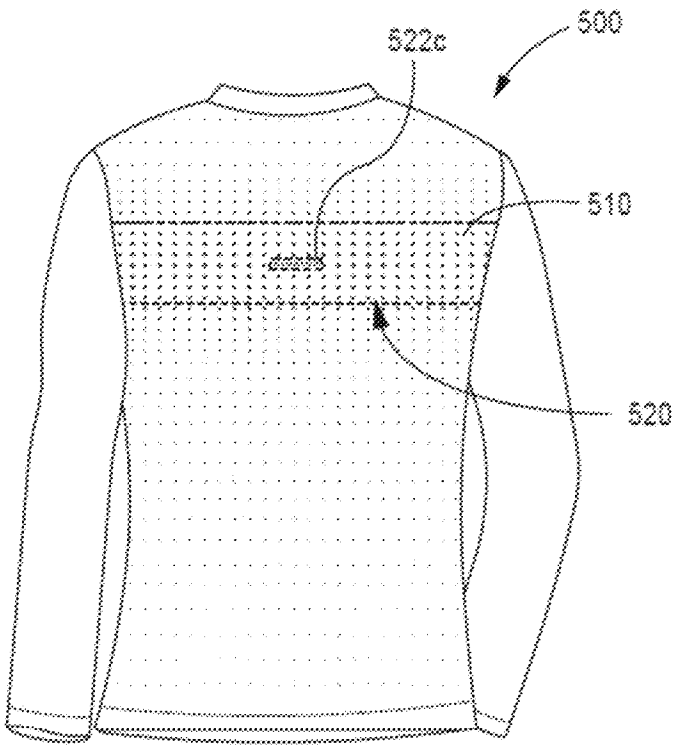
FIG. 5B shows a back schematic plan view of a biosensing shirt having a compression gradient along a vertical axis and a horizontal axis of the shirt, according to an embodiment.
Figure 5A:
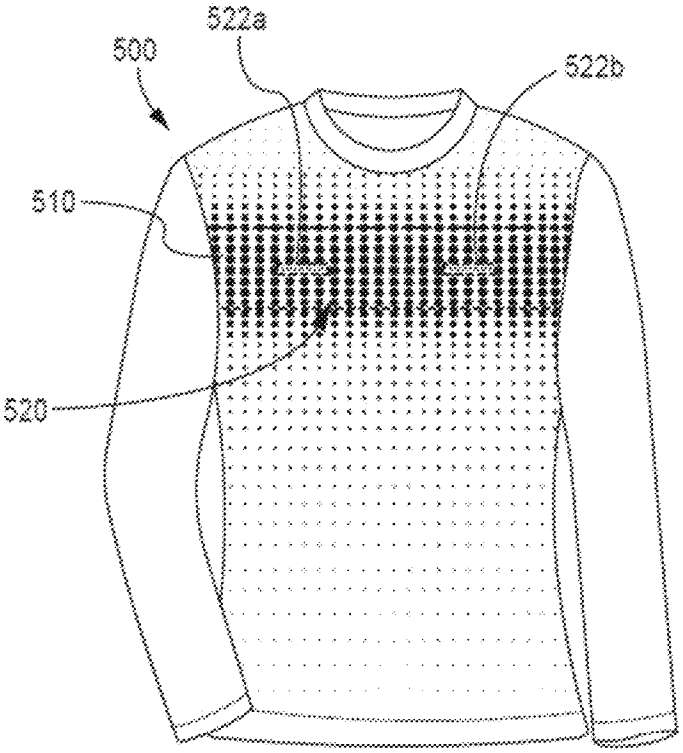
FIG. 5A shows a front schematic plan view.

FIGS. 5A and 5B (corresponding to front and rear views, respectively) depict a biosensing shirt 500 according to embodiments of the present disclosure, the biosensing shirt 500 including a fabric portion 510 configured to be disposed about a torso of a user U, the fabric portion 510 comprising a gradient compression rating distribution and an inner surface that includes at least a portion of a sensor assembly 520 configured to be placed in contact with the skin of a user U. The sensor assembly 520 includes electrodes 522*a*, 522*b* and 522*c*, each disposed on the inner surface of the biosensing shirt 500 and positioned substantially within an inner circumferential region of the biosensing shirt 500 such that, when worn, the electrodes 522*a*, 522*b* and 522*c* contact the chest and back regions of the user's body. An anterior or "front" region of fabric portion 510 that includes electrodes 522*a* and 522*b* is configured to have a "peak" compression rating. Such a configuration is suitable, for example, in ECG applications to monitor a user's heart rate. Compression ratings of biosensing shirt 500 are represented by a "stippling" pattern comprising dots of varying size. Larger diameter dots indicate a higher relative compression rating for the corresponding region of fabric portion 510, while lower diameter dots indicate a lower relative compression rating for the corresponding region of fabric portion 510. Additionally, the spacing between adjacent dots within the stippling pattern indicate "slope" or steepness (as described above with regard to FIGS. 4A and 4B) of the change in compression rating across the biosensing shirt 500. As such, FIGS. 5A and 5B depict a relatively steep fall-off in compression rating moving vertically away (both upwards and downwards along the vertical axis of the biosensing shirt 500) from the region of biosensing shirt 500 having the "peak" compression rating, followed by a more gradual taper, in both directions, of the compression rating (i.e., to minimum values at the neck and lower hemline portions of the biosensing shirt 500). Additionally, the compression rating varies along the inner circumferential region of the biosensing shirt 500 that surrounds the user's chest region. For example, as can be seen by comparing the chest region of FIG. 5A with the back region of FIG. 5B, the relative compression rating is higher in the part of fabric portion 510 occupying the chest region than the relative compression rating in the part of fabric portion 510 occupying the back region. Although the compression rating variation of biosensing shirt 500 is shown in FIGS. 5A and 5B as varying substantially along vertical and horizontal/circumferential axes, in some embodiments, the compression rating may vary nonlinearly and/or along multiple axes (e.g., vertical, horizontal, and/or oblique axes). For example, in some embodiments, the compression rating of the shirt may vary radially outwardly from a region of relatively high compression. In such embodiments, the variation of compression rating may be symmetric or asymmetric.

Figure 6:
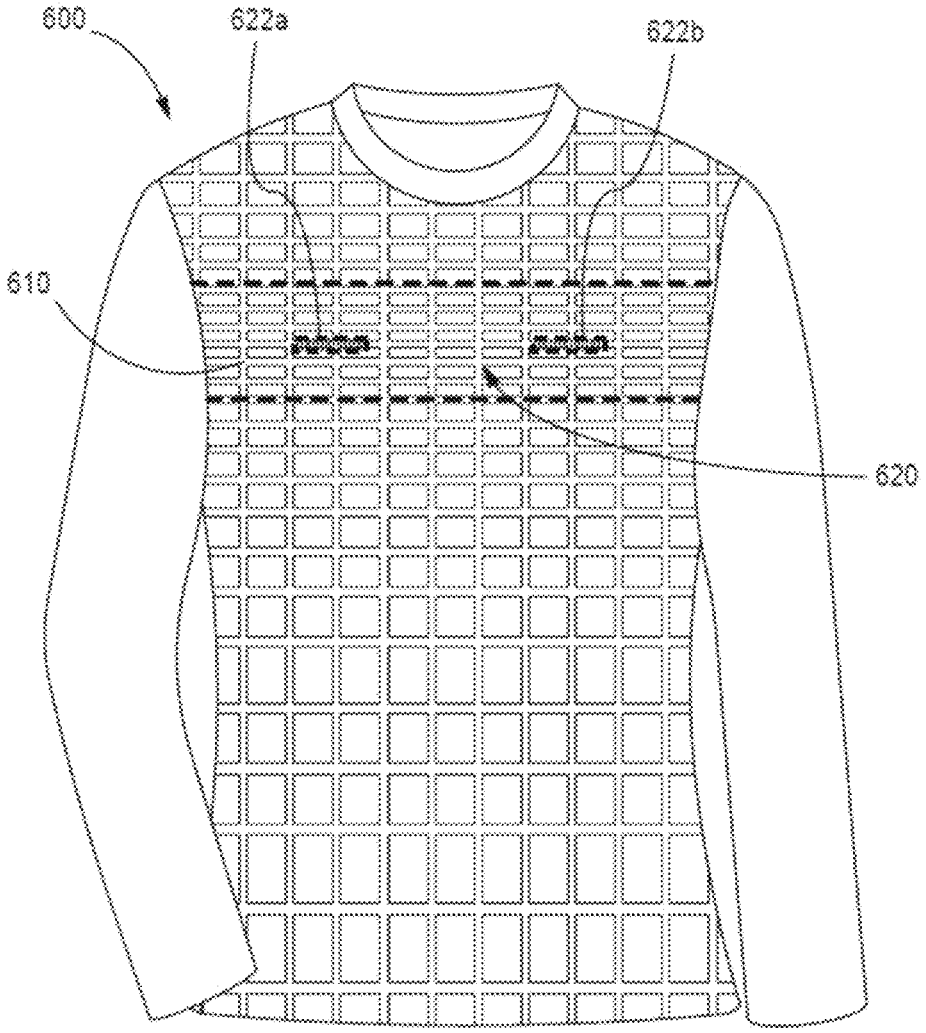
FIG. 6 shows a front schematic plan view of a biosensing shirt having a compression gradient, according to an embodiment.

FIG. 6 depicts a front view of a biosensing shirt 600 according to embodiments of the present disclosure, the biosensing shirt 600 including a fabric portion 610 configured to be disposed about a torso of a user U, the fabric portion 610 comprising a gradient compression rating distribution and an inner surface that includes at least a portion of a sensor assembly 620 configured to be placed in contact with the skin of a user U. The sensor assembly 620 includes electrodes 622*a* and 622*b*, both disposed on the inner surface of the biosensing shirt 600 and positioned substantially within a chest region of the biosensing shirt 600 such that, when worn, the electrodes 622*a* and 622*b* contact the chest of the user's body. The anterior or "front" region of fabric portion 610 that includes electrodes 622*a* and 622*b* is configured to have a "peak" compression rating. Such a configuration is suitable, for example, in ECG applications to monitor a user's heart rate. Compression ratings of biosensing shirt 600 are represented by a substantially rectangular pattern comprising four-sided features of varying size and aspect ratio. Smaller features (i.e., by two-dimensional area) represent higher relative compression ratings for the corresponding region of fabric portion 610, while larger features represent a lower relative compression rating for the corresponding region of fabric portion 610. Additionally, the sequencing of features within the pattern can indicate "slope" or steepness of the change in compression rating across the biosensing shirt 600. For example, the greater the difference in area between adjacent features within the pattern, the steeper the change in relative compression rating. As such, FIGS. 6A and 6B depict a relatively steep fall-off in compression rating moving vertically away (both upwards and downwards along the vertical axis of the biosensing shirt 600) from the region of biosensing shirt 600 having the "peak" compression rating, followed by a more gradual taper, in the upward direction, and a continuing steep drop-off in the down ward direction, of the compression rating (i.e., to minimum values at the neck and lower hemline portions of the biosensing shirt 600). Although the compression rating variation of biosensing shirt 600 is shown in FIGS. 6A and 6B as varying substantially along a vertical axis, in some embodiments, the compression rating may vary nonlinearly and/or along multiple axes (e.g., vertical, horizontal, and/or oblique axes). For example, in some embodiments, the compression rating of the shirt may vary radially outwardly from a region of relatively high compression. In such embodiments, the variation of compression rating may be symmetric or asymmetric.

Figure 7B:
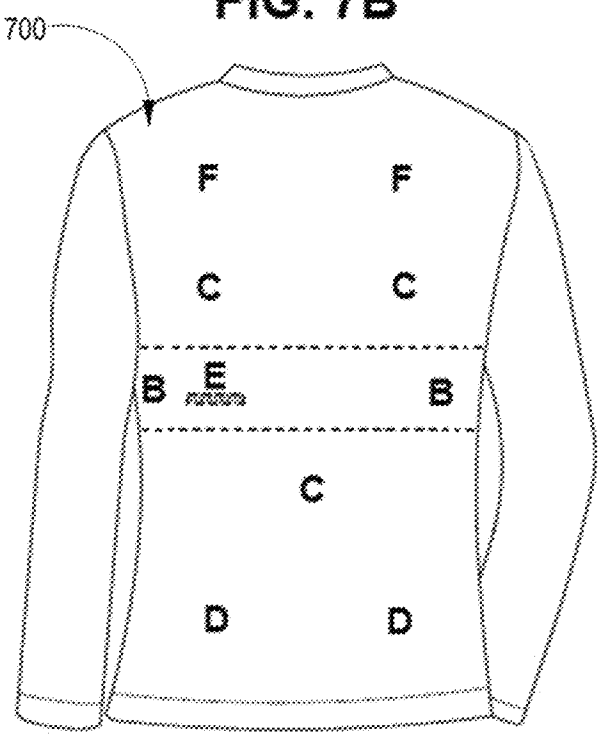
FIG. 7B shows a back schematic plan view of a biosensing shirt having a plurality of compression regions, according to an embodiment.
Figure 7A:
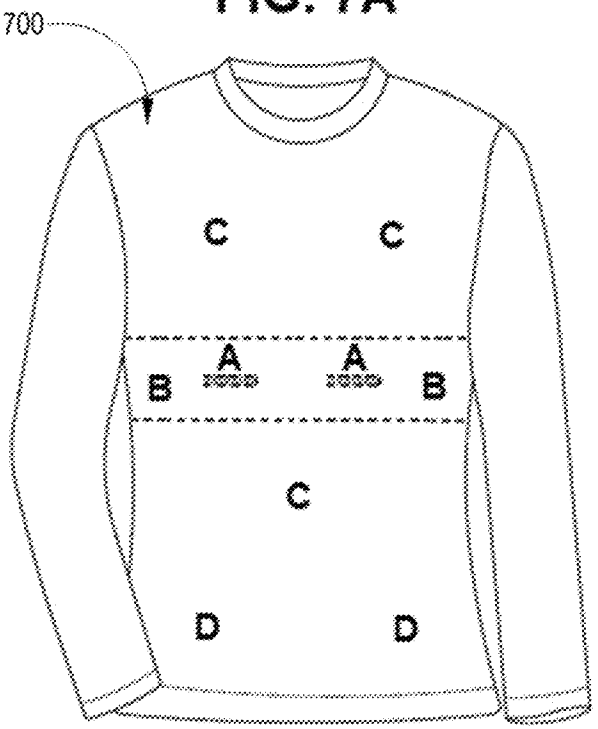
FIG. 7A shows a front schematic plan view.

FIGS. 7A and 7B (corresponding to front and rear views, respectively) depict a biosensing shirt according to embodiments of the present disclosure, having a plurality of compression regions or "zones" with compression ratings classified by alphabetical letters. Common letters indicate regions having approximately the same compression ratings. With reference to Table 1 below, FIG. 7A shows a biosensing shirt 700 having a band-like lower chest region (between the two horizontal dashed lines), including two electrodes disposed on an inner surface thereof. Zones "A" include portions of the lower chest region that each include one of the electrodes, and have a compression rating of from 5 mmHg to 7 mmHg. Zones "B" are disposed on the outer "sides" of the anterior of the biosensing shirt 700, each positioned between one of the zones "A" and an arm of the shirt. In some embodiments, zones "B" continue in a substantially circumferential direction away from a longitudinal center line of the biosensing shirt 700 and in the direction of the back of the biosensing shirt 700 (and, hence, may include at least a portion of the "sides" of the garment, i.e., in the under-arm region or just below). Zones "B" can have a compression rating of from about 4 mmHg to about 6 mmHg. Two zones "C" are disposed above the lower chest region (one adjacent to and/or including the right shoulder, and one adjacent to and/or including the left shoulder), and one zone "C" is disposed below the lower chest region (e.g., an upper abdominal region). Although there are two such zones "C" depicted above the lower chest region, in some embodiments these regions are integrally or "monolithically" formed with one another and essentially comprise a singular, contiguous zone "C." Zones "C" have a compression rating of from 1 mmHg to 3 mmHg. Zones "D" are disposed between the zone "C" that is disposed below the lower chest region and, in some embodiments, extend to a lower hem of the biosensing shirt 700 (e.g., zones "D" covering a lower abdominal region). Although there are two such zones "D" depicted below the lower chest region, in some embodiments these regions are integrally or "monolithically" formed with one another and essentially comprise a singular, contiguous zone "D." Zones "D" have a compression rating of from 0 mmHg to 1 mmHg. In some embodiments, the compression rating of zones "D" is lower that the compression rating of zones "C."

With further reference to Table 1 below, FIG. 7B shows a biosensing shirt 700 having a band-like lower back region (between the two horizontal dashed lines), including one electrode disposed on an inner surface thereof. Zone "E" includes a portion of the lower back region that includes the one electrode, and has a compression rating of from 6 mmHg to 8 mmHg. Zones "B" are disposed on the outer "sides" of the posterior of the biosensing shirt 700, each positioned between zone "E" and an arm of the shirt. In some embodiments, these zones "B" continue in a substantially circumferential direction away from a longitudinal center line of the biosensing shirt 700 and in the direction of the front of the biosensing shirt 700 (and, hence, may include at least a portion of the "sides" of the garment, i.e., in the under-arm region or just below). In some embodiments the zones "B" of FIG. 7A and the zones "B" of FIG. 7B are connected (e.g., are integrally or "monolithically" formed with one another and essentially comprise a singular, contiguous zone). Zones "B" have a compression rating of from 4 mmHg to 6 mmHg. Two zones "C" are disposed above the lower back region (one between the lower back region and the right shoulder, and one between the lower back region and the left shoulder), and one zone "C" is disposed below the lower back region. Although there are two such zones "C" depicted above the lower back region, in some embodiments these regions are integrally or "monolithically" formed with one another and essentially comprise a singular, contiguous zone "C." Zones "C" have a compression rating of from 1 mmHg to 3 mmHg. Two zones "F" are also disposed above the lower back region (one between the zone "C" nearest to the right shoulder, and one between the zone "C" nearest to the left shoulder). Zones "F" have a compression rating of from 3 mmHg to 4 mmHg. Zones "D" are disposed between the zone "C" that is disposed below the lower back region and, in some embodiments, extend to a lower hem of the biosensing shirt 700 (e.g., zones "D" covering a lower back region). Although there are two such zones "D" depicted below the lower zone "C" region, in some embodiments these regions are integrally or "monolithically" formed with one another and essentially comprise a singular, contiguous zone "D." Zones "D" have a compression rating of from 0 mmHg to 1 mmHg. In some embodiments, the compression rating of zones "D" is lower that the compression rating of zones "C."

In some embodiments, a compression rating of 0 mmHg is qualitatively described as having "no compression," and/or a "lowest" value of compression; a compression rating of from 1-2 mmHg is qualitatively described as having "low" compression; a compression rating of from 3-4 mmHg is qualitatively described as having "moderate" compression; a compression rating of from 5-6 mmHg is qualitatively described as being in a "functional range"; a compression rating of from 7-8 mmHg is qualitatively described as having "high" compression; and a compression rating of 9 mmHg or greater is qualitatively described as having "very high" compression.

TABLE 1

Exemplary Compression Values for Zones Shown in FIGS. 7A and 7B

| ZONE | RANGE OF COMPRESSION RATINGS (in mmHg) |
|---|---|
| A (UNDER PADDED FRONT ELECTRODES) | 5-7 |
| B (SIDES) | 4-6 |
| C (ABOVE & BELOW BAND REGION) | 1-3 |
| D (HEM REGION) | 0-2 |
| E (UNDER PADDED BACK ELECTRODE) | 6-8 |
| F (UPPER BACK) | 3-4 |

Although the compression ratings provided in Table 1 above, and described with reference to FIGS. 7A and 7B, were experimentally determined (through the use of a compression tool, described herein), the compression ratings that are practically realized (e.g., when worn by a user "U") can vary depending on factors such as (but not limited to) body proportions, body compositions, size, shape, and/or activity level of the user "U," age, composition and/or "wear" of the garment, and/or the like. For example, not only may the compression rating for particular zone vary for a particular garment depending on the user "U," but also the relative compression of one or more zones with respect to one or more other zones on the same garment may also vary depending upon the user "U." As such, in some embodiments the compression ratings of Table 1 may be used as "baseline" values for comparing the fit of a particular biosensing garment on different types of users "U." In some embodiments, compression ratings of the biosensing garments of the disclosure may be within +/−1 mmHg of the baseline value. In some embodiments, compression ratings of the biosensing garments of the disclosure may be within +/−2 mmHg of the baseline value. As such, in some embodiments, zones "A" have a compression rating of from 3 mmHg to 9 mmHg or from 4 mmHg to 8 mmHg; zones "B" have a compression rating of from 4 mmHg to 8 mmHg or from 5 mmHg to 7 mmHg; zones "C" have a compression rating of 5 mmHg or less, or of 4 mmHg or less; zones "D" have a compression rating of 4 mmHg or less, or of 3 mmHg or less; zone "E" has a compression rating of from 4 mmHg to 10 mmHg or from 5 mmHg to 9 mmHg; and zones "F" have a compression rating of from 1 mmHg to 6 mmHg or from 2 mmHg to 5 mmHg. Furthermore, in some embodiments, lower levels of compression ratings may be required in order to achieve the proper performance/comfort tradeoff. For example, fabrics that act as a "second skin" and are designed to make intimate contact with the user's skin can require lower compression ratings in order to achieve comparable signal performance/detectability as compared with looser-fitting fabrics.

Figure 8B:
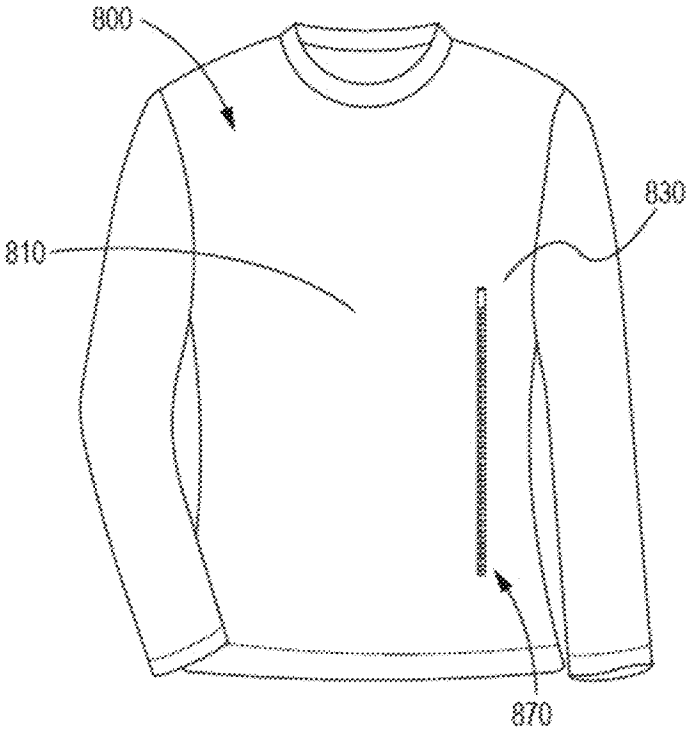
FIG. 8B shows a back schematic plan view of a biosensing shirt having a compression modification system in a first configuration and a second configuration, respectively, according to an embodiment.
Figure 8A:
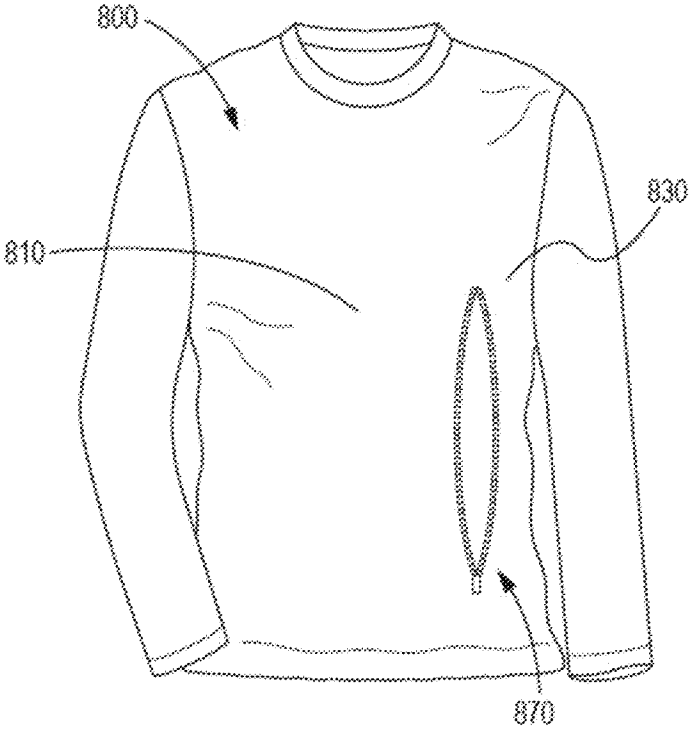
FIG. 8A shows a front schematic plan view.

FIGS. 8A and 8B show perspective views of a biosensing shirt 800 having a compression modification system in a first configuration and a second configuration, respectively, according to an embodiment. An inner surface of the biosensing shirt 800 includes at least a portion of a sensor assembly (not shown), for example configured to be placed in contact with the skin of user U. The biosensing shirt 800 includes a first fabric region 810 and a second fabric region 830 extending from the first fabric region 810, the first fabric region 810 and second fabric region 830 defining a variable circumference of at least a portion of the biosensing shirt 800 and the first fabric region 810 and second fabric region 830 being joinable along an interface therebetween by a compression modification system 870. The first fabric region 810 and second fabric region 830 are configured to be disposed, collectively, about a torso of a user U, and configured to collectively exert a first level of compression (corresponding to a first compression rating) to a user U when the biosensing shirt 800 is worn by the user U in the first configuration. The first configuration, shown in FIG. 8A, is a configuration in which the compression modification system 870 is positioned such that it minimally joins (or does not join) first fabric region 810 and second fabric region 830, collectively defining a first, "maximum" circumference of the biosensing shirt 800 and, correspondingly, applying a minimum amount of compression to the user U. The first fabric region 810 and second fabric region 830 are further configured to collectively exert a second level of compression (corresponding to a second compression rating) to a user U when the biosensing shirt 800 is worn by the user U in the second configuration. The second configuration, shown in FIG. 8B, is a configuration in which the compression modification system 870 is positioned such that it fully joins first fabric region 810 and second fabric region 830, collectively defining a second, "minimum" circumference of the biosensing shirt 800 and, correspondingly, applying a maximum amount of compression to the user U. Although not shown in FIGS. 8A and 8B, further configurations are contemplated in which the compression modification system 870 is positioned such that it joins first fabric region 810 and second fabric region 830 to an "intermediate" degree (i.e., to any degree of joining between not joined and fully joined), collectively defining an intermediate circumference of the biosensing shirt 800 and, correspondingly, applying an intermediate amount of compression to the user U. In some embodiments, the compression modification system 870 comprises a zipper. In other embodiments, the compression modification system 870 comprises one or more of the following mechanisms (by way of example): straps, belts, velcro, compression pads, elastic, lacing, buckles, hook-and-eye closures, inches, and/or other suitable mechanical implements and/or closure means. The compression modification system 870 may be incorporated into biosensing garments of the disclosure at any location, including the anterior, posterior, lateral, limb, neck and/or waist portions of the garment, for example such that the compression modification system 870 is configured to apply compression to a targeted portion of a user's U anatomy.

Figure 9A:
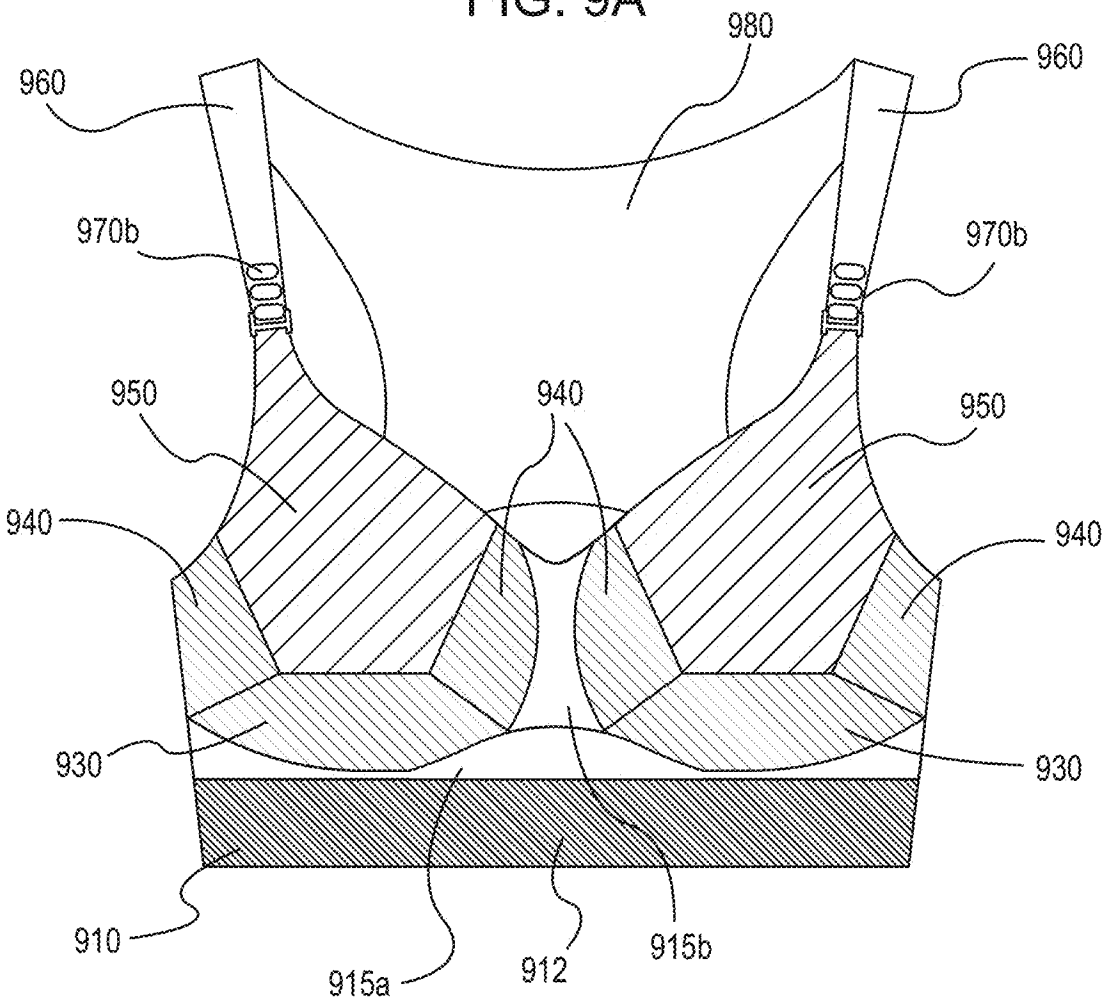
FIG. 9A shows a front schematic plan view.
Figure 9B:
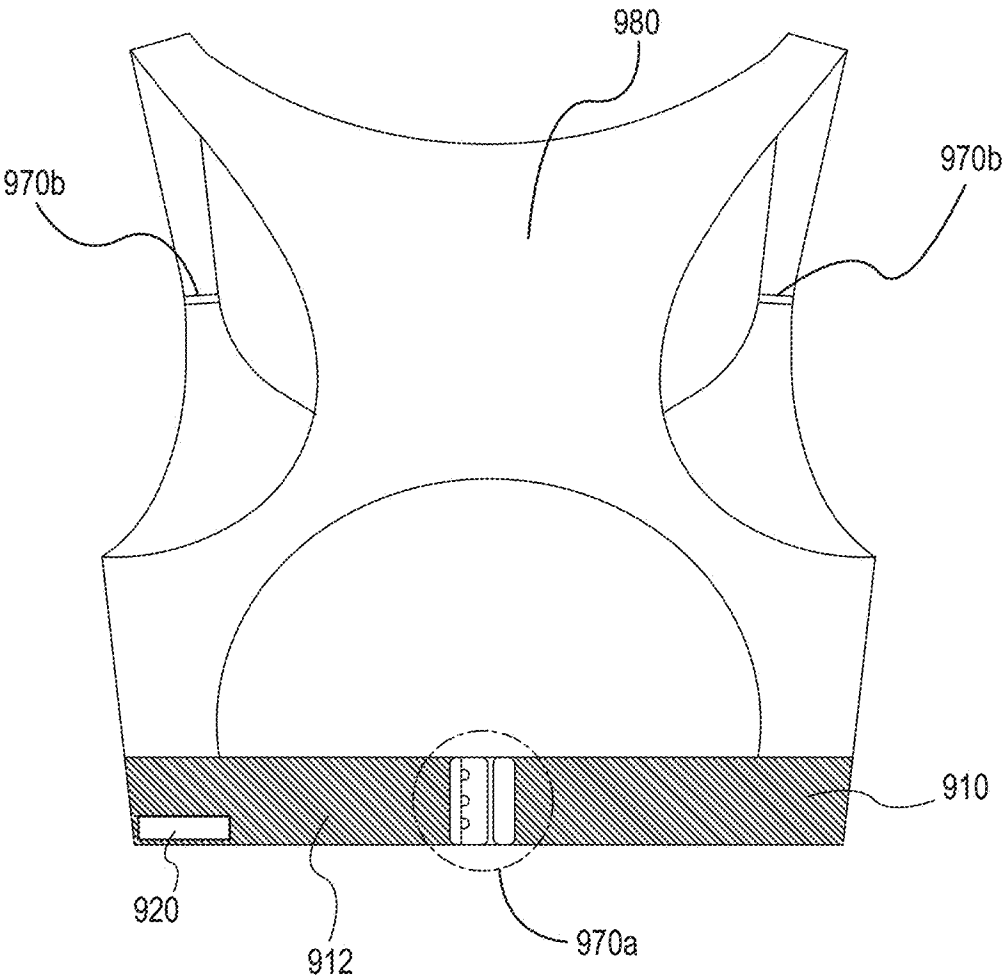
FIG. 9B shows a back schematic plan view of a biosensing bra having a plurality of compression regions, according to an embodiment.

Turning now to FIGS. 9A and 9B (corresponding to front and rear views, respectively), in some embodiments of the present disclosure a biosensing bra 900 includes a band 912 configured to be disposed about the chest region of a user U. The chest band 912 includes a first fabric portion 910 having a width sufficient (e.g., about 2") to accommodate a sensor assembly 920. For such designs, where the sensing elements are disposed within the band, the upper portion of the biosensing bra 900 can be altered freely and can be independent of (or without interfering with) the biosensing technology/elements. Although a 2" wide chest band may be needed and/or sufficient to accommodate some configurations/collections of hardware, embodiments with other hardware configurations (e.g., involving a different number and/or size of the hardware components) may invoke, allow, or necessitate the use of a narrower or wider chest band.

As described herein, the first fabric portion 910 has a first compression rating and an inner surface that includes at least a portion of the sensor assembly 920 configured to be placed in contact with the skin of the user U. The sensor assembly 920 is disposed on the inner surface of the biosensing bra 900 and is positioned substantially within an inner circumferential region of the biosensing bra 900 such that, when worn, the electrodes of the sensor assembly 920 make contact with the chest and/or back regions of the user's U body. As described above, such a configuration is suitable, for example, in ECG applications to monitor a user's heart rate.

The biosensing bra 900 includes a second fabric portion 930 extending from the first fabric portion 910, configured to be positioned near the bottom regions of the cups in the biosensing bra 900 so as to support the breasts of the user U. In some embodiments, the second fabric portion 930 has a second compression rating that is less than the first compression rating. In some embodiments, the second compression rating that is greater than the first compression rating. In some embodiments, the second compression rating is substantially equal to the first compression rating. The biosensing bra 900 also includes a third fabric portion 940 extending from the second fabric portion 930 to the sides of the cups of the biosensing bra 900 so as to extend the compression region from the second fabric portion 930. In some embodiments, the third fabric portion 940 has a third compression rating that is less than the second compression rating. In some embodiment, the third compression rating is greater than the second compression rating. In some embodiments, the third compression rating is substantially equal to the second compression rating. The biosensing bra 900 also includes a fourth fabric portion 950, which extends upwards from the second fabric portion 930 and third fabric portion 940. The second fabric portion 930, the third fabric portion 940, and the fourth fabric portion 950 are configured to impart a gradual transition from a relatively higher compression regions of the cups of the biosensing bra 900 where support is desirable, to regions of relatively lower compression regions of the cups of the biosensing bra 900 where support is not necessary. In some embodiments, the fourth fabric portion 950 has a fourth compression rating that is less than the second compression rating and/or the third compression rating. In some embodiments, the fourth compression rating is substantially equal to the second compression rating and the third compression rating. The biosensing bra 900 also includes a fifth fabric portion 960 on the straps having a fifth compression rating, and a sixth fabric portion 980 on the back having a sixth compression rating. In some embodiments, the fifth and sixth compression ratings can be very low in terms of absolute compression rating. In some embodiments, the fifth compression rating can be greater than the sixth compression rating. In some embodiments, the fifth compression rating can be less than the sixth compression rating. In some embodiments, the fifth compression rating is substantially equal to the sixth compression rating. In some embodiments, the fifth and sixth compression ratings can be essentially zero meaning that the fabric is "form fitting," but does not apply any compression to the skin of the user. As shown in FIGS. 9A and 9B, fabric portions 910, 930, 940 and 950 present a "stepwise" distribution of discrete regions adjacent to one another (e.g., integrally formed within the same garment), each having a substantially uniform compression rating, however, the biosensing bra 900 can be configured to have a relatively gradual compression gradient throughout the bra 900 to maximize comfort for the user U.

As indicated by the differences in shading throughout FIGS. 9A and 9B, the biosensing bra 900 comprises a plurality of discrete regions, each having a different absolute compression level (e.g., in mmHg) (i.e., regions having the same type of shading have substantially the same average compression rating across their respective regions). For example, fabric portions 960 and 980 have a "lowest" absolute compression rating. Fabric portions 950, the upper parts of the cups of the biosensing bra 900, have a "low" absolute compression rating that is higher than the "lowest" absolute compression rating. Third fabric portions 940, the sides of the cups, and second fabric portions 930, the bottoms of the cups, have a "moderate" absolute compression rating that is higher than the "low" absolute compression rating. First fabric portion 910, wrapping around the circumference of the user's U chest and including the sensor assembly 920, has a "high" absolute compression rating that is higher than the "moderate" absolute compression rating. Accordingly, the transition of compression value from the first fabric portion 910 to other fabric portions of the biosensing bra 900 is "stepwise," for example as follows: (1) moving upwards from the midline of the chest band (i.e., from the first fabric portion 910) towards the bottom of the cups of the biosensing bra 900, the compression rating changes from the first ("high" absolute) compression rating, to the second ("moderate" absolute) compression rating, to the fourth ("low") absolute compression rating; (2) moving laterally from the center of the cups of the biosensing bra 900, the compression rating changes from the second ("moderate" absolute) compression rating, to the third ("moderate" absolute) compression rating; and (3) moving upward from to the fifth ("very low") absolute compression rating, across the straps to the sixth ("very low") absolute compression rating over the shoulder of the user to the back of the biosensing bra 900, which has the ("very low") absolute compression rating. In some embodiments, the sequencing of compression ratings among the multiple fabric portions of the biosensing bra 900 (or other type of garment) varies from the sequencing hereinbefore described. In other words, any combination and sequencing of compression ratings among the multiple fabric portions of the biosensing bra 900 (or other type of garment) is contemplated by the present disclosure.

In some embodiments, the intermediate regions 915*a* and 915*b* (collectively, intermediate regions 915) can be the regions of fabric with compression ratings that are in-between those of the conjoining fabric portions. For example, the first fabric portion 910 and the second fabric portion 930 can include an intermediate region 915*a* such that the compression ratings can gradually change from the first fabric portion 910 to the second fabric portion 930. This means the compression rating of the intermediate region 915*a* can be somewhere between the compression ratings of the first fabric portion 910 and the second fabric portion 930. In some embodiments, the two third fabric portions 940 in the middle of the biosensing bra 900 (i.e., between the two cups) can include an intermediate region 915*b* such that the compression ratings can gradually go from the compression rating of the third fabric portion 940 to the other third fabric portion 940. In this case since both the third fabric portions 940 have the same compression rating, the compression rating of the intermediate region 915*b* can be the same or substantially as the compression rating of the third fabric portion 940. In some embodiments, the intermediate regions 915 can have a compression rating that is substantially similar to adjacent fabric portions to provide a relatively gradual compression gradient throughout the bra 900 to maximize comfort for the user U.

In some embodiments, the intermediate regions 915*a* and 915*b* can have a substantially low compression rating. For example, the two third fabric portions 940 in the middle of the biosensing bra 900 (i.e., between the two cups) can include an intermediate region 915*b* such that the compression ratings can gradually go from the compression rating of the third fabric portion 940 to the other third fabric portion 940. But since the intermediate region 915*b* can have a relatively low compression rating, the compression can be discontinuous. In another word, the two cups of the biosensing bra 900 can be substantially compressive, yet they can be independently compressive, where the compression of the two cups can be isolated from each other by having the intermediate region 915*b* with a relatively low compression rating in between.

In some embodiments, the biosensing bra can include one or more compression modification systems 970*a* and/or 970*b* (collectively, compression modification system 970). As described above, the first fabric portion 910 is configured to be disposed about a torso of a user U, and is configured to exert a first level of compression (corresponding to the first compression rating) to the user U when the biosensing bra 900 is worn by the user U in a first configuration. The compression modification system 970*a* can allow the user U to tighten or loosen the chest band 912 to transition the biosensing bra 900 to a second configuration to exert a second level of compression. The second level of compression can be greater than or less than the first level of compression. The compression modification system 970*a* can allow the user U to modify the biosensing bra 900 to achieve a more comfortable fit and/or to improve signal quality from the sensor assembly 920. Similarly, the compression modification system 970*b* can allow the User to modify the compression in the cup region of the biosensing bra to achieve a more comfortable fit and/or to improve support.

Exemplary test data comparing a properly fitting biosensing shirt according to some embodiments with a biosensing shirt that is too large for a user ("User 1") is provided in Table 2 below. In both cases, the same user (User 1) is wearing the shirt under test, and each of the XS and the S shirt employ the same sensor type. User 1 is normally an XS (i.e., XS is the size that properly fits User 1), while a size S is too large for User 1 (i.e., it fits "loosely"). As shown in Table 2, the signal quality for the XS biosensing shirt, when worn by User 1, is higher than the signal quality for the S biosensing shirt, when worn by User 1.

TABLE 2

Exemplary Fit Data for User 1: XS (proper size) and S (too large) biosensing garments

| | User ID: | |
|---|---|---|
| | User 1 | User 1 |
| Garment Size | XS | S |
| Total duration of recording (seconds) | 2805.036 | 2790.596 |
| Signal quality | 61.49097552 | 43.19994725 |

In some embodiments, biosensing garments may comprise one or more textiles (e.g., cloths, fabrics etc.) consisting of a network of natural or synthetic fibers. The textiles may derive from one or more sources, including plant sources (e.g., cotton, flax, hemp, jute, modal, bamboo, piña, ramie, milkweed stalk, lyocell, polyamide, etc.), animal sources (e.g., wool, silk, milk proteins, etc.), mineral sources (e.g., asbestos, glass fibres, etc.), and/or synthetic sources (e.g., nylon, polyester, polyamide, acrylic, aramid fibre, spandex, polyurethane, olefin fibre, ingeo, polylactide, lurex, carbon fibre, etc.). Strands from which the textiles are composed may include coatings such as waxes. Such textiles may be formed from one or more processes, including (but not limited to): weaving, knitting (e.g., circular knitting), crocheting, forming from tow, braiding, felting, thermal and/or mechanical bonding, and/or the like. When a textile is formed by knitting, any suitable knitting pattern can be used, for example, circular knitting (also known as "knitting in the round," creating a seamless tube), single, double, jersey, interlocked, mock rib, ribbed, two-way stretch, or any other suitable knitting pattern or combination thereof.

Although embodiments described herein and depicted in the figures show placement of electrodes in the vicinity of a wearer's chest, other locations (i.e., corresponding with other portions of a user's anatomy) can also be suitable, and are contemplated by this disclosure. By way of non-limiting example, one or more electrodes may be positioned on a shoulder region, arm region, wrist region, abdominal region, torso region, back region, side region, or any other location on a biosensing garment that allows for the detection of biosignals.

Although embodiments described herein and depicted in the figures show particular exemplary distributions of compression regions (e.g., in "bands"), other shapes and positioning of compression regions (whether substantially uniform in compression value or variable in compression value) are also contemplated by this disclosure. By way of non-limiting example, compression regions of the disclosure may have an asymmetric, circular, polygonal, circumferential, patch, or any other suitable shape. Also, by way of non-limiting example, compression regions of the disclosure may be positioned on a shoulder region, arm region, wrist region, abdominal region, torso region, or any other location on a biosensing garment.

As used herein, the term "electrode" refers to a conductor whose function is to interact with a part of a circuit. In some embodiments, the electrode can be knitted from a conductive yarn such as, for example, XSTATIC® silver metallized yarn, stainless steel thread, polyaniline yarn, and/or any other suitable conductive yarn. In some embodiments, the electrode comprises SCHOELLER® wool. The electrode of the present disclosure may comprise any suitable electrical conductor, including metals such as (but not limited to) copper, silver, steel (e.g., stainless steel), tin, lead, tin/lead (SnPb), gold, platinum, aluminum, nickel, zinc, combinations or alloys thereof, and/or the like, carbon (including metallized, non-metallized, mediated and non-mediated), electroceramics, and/or conductive polymers. Electrodes of the present disclosure may take the form of inks, films (e.g., screen-printed, vacuum-deposited, painted, and/or the like), foils, plates, thin films, thick films, rivets, connectors (e.g., snaps), threads, wires, combinations thereof, and/or the like. In some embodiments, electrodes of the present disclosure may include "chemically modified electrodes" (CMEs), "ion-selective electrodes" (ISEs), and/or any electrode suitable for use in electrochemical applications. In some embodiments, the electrode itself may serve as and/or comprise a sensing element.

The electrodes of the present disclosure can have any suitable size or shape such as, for example, square, rectangular, circular, elliptical, oval, polygonal, or any other suitable shape. In some embodiments, a padding member can be disposed on the outer surface of a fabric layer adjacent to an electrode. The padding member can be formed from any suitable material such as, for example, rubbery foam, a sponge, memory foam, a 3-D knitted porous fabric (e.g., a 3-D knitted mesh or 3-D spacer knit), any other suitable material or combination thereof. The padding member can, for example, be configured to urge the electrode towards the skin of the user, for example, to enable efficient contact of the electrode with the skin of the user. In some embodiments, the padding member can be also be configured to prevent rubbing of the electrode against the fabric layer adjacent to the electrode, thereby reducing noise. In some embodiments, the padding member can be disposed between a fabric layer and an adjacent electrode.

In some embodiments, biosensing garments described herein may be designed to include and/or interface with one or more sensors or sensor assemblies, including (but not limited to) electrical sensors (e.g., bio-potential, breath rhythm, sweat conductivity, etc.), electrochemical sensors (e.g., pH, ion, etc.), organic sensors (e.g., protein detection, etc.), electrocardiogram (ECG or EKG) sensors, heart rate sensors, breathing rate sensors, temperature sensors and/or other physical biosensors, chemical sensors, acoustic wave sensors, IR sensors, UV sensors, humidity sensors, moisture sensors, ion sensors (e.g., capable of detecting the presence of chloride, sodium, potassium, calcium, magnesium, etc.), motion sensors, accelerometers, glucose detectors, pressure sensors, strain sensors, on-skin sensors, and/or the like. In some embodiments, the sensor assemblies described herein are configured to perform skin conductance measurements in order, for example, to determine an Electrodermal Response (EDR) and/or an Electrodermal Level (EDL). Sensors according to the present disclosure may be in the form of discrete parts mounted to, embedded in, or located apart from the biosensing garment. In some embodiments, sensors according to the present disclosure may comprise a coating on at least a portion of the textile material and/or on the fibers from which the textile or "fabric" material is formed.

In some embodiments, biosensing garments described herein, by virtue of the operation of their respective sensor assemblies and, optionally, with further processing of signals received and transmitted by the sensor assemblies, determine quantitative data about a user/wearer, such as (but not limited to): heart rate, heart rate variability, activity level, activity schedule, sleep schedule, calorie expenditure, breathing rate, blood pressure, blood sugar, VO2 max, oxygen saturation, hydration level, skin temperature, and/or other physiological data. In some embodiments, biosensing garments described herein, by virtue of the operation of their respective sensor assemblies and, optionally, with further processing of signals received and transmitted by the sensor assemblies, determine one or more qualitative properties of a user/wearer, such as (but not limited to): state of health, physiological condition (e.g., hydration, sleep deficit, sleep patterns), cognitive mental state, tension, and/or emotional mental state (e.g., happiness, sadness, concentration, confusion, frustration, disappointment, hesitation, cognitive overload, focus, degree of engagement, attentiveness, boredom, confidence, trust, delight, satisfaction, worry, curiosity, and/or the like).

As used herein, the terms "about" and "approximately" generally mean plus or minus 10% of the value stated, for example about 250 μm would include 225 μm to 275 μm, about 1,000 μm would include 900 μm to 1,100 μm.

As used herein, the term "knit" or "knitted" refers to layers, portions, or components included in a textile-based electrode system that are formed by interlacing yarn or threads in a series of connected loops with needles.

As used herein, the term "electrode" refers to an electrical conductor configured to contact a non-metallic surface including a skin of a user (e.g., a human or an animal) and measure electrical signals corresponding to one or more physiological parameters of the user.

As used herein, the terms "continuously," "seamless" and "seamlessly" refer to the integration of layers, portions, or components included in a textile-based electrode system without any seams, interruptions, transitions, or indications of disparity resulting in a visually appealing appearance which improves a user comfort by reducing chafing and pressure on the skin that are usually caused by seams.

While various embodiments of the system, methods and devices have been described above, it should be understood that they have been presented by way of example only, and not limitation. Where methods and steps described above indicate certain events occurring in a certain order, those of ordinary skill in the art having the benefit of this disclosure would recognize that the ordering of certain steps may be modified and such modification are in accordance with the variations of the invention. Additionally, certain of the steps may be performed concurrently in a parallel process when possible, as well as performed sequentially as described above. The embodiments have been particularly shown and described, but it will be understood that various changes in form and details may be made.

The invention claimed is:

1. A biosensing shirt, comprising:

a first fabric portion configured to be disposed about a circumferential region of a user, the first fabric portion having an inner surface including a sensor assembly, the first fabric portion having a first compression rating such that, when the biosensing shirt is worn by the user, the first fabric portion is configured to retain the sensor assembly within the circumferential region of the user and in conductive contact with the skin of the user;

a second fabric portion extending from the first fabric portion in a direction of a neck of the biosensing shirt, the second fabric portion having a second compression rating less than the first compression rating;

a third fabric portion extending from the first fabric portion in a direction of a lower hem of the biosensing shirt, the third fabric portion having a third compression rating less than the first compression rating;

a first integrally knit compression gradient that decreases linearly from the first compression rating to the second compression rating, all the way to the neck of the biosensing shirt; and a second integrally knit compression gradient that decreases linearly from the first compression rating to the third compression rating, all the way to the lower hem of the biosensing shirt.

2. The biosensing garment of claim 1, further comprising:

a fourth fabric portion extending from the second fabric portion, the fourth fabric portion having a fourth compression rating less than the second compression rating.

3. The biosensing garment of claim 2, wherein the decreasing compression rating from the first compression rating to the second compression rating, and from the second compression rating to the fourth compression rating provides a uniform compression gradient from the first fabric portion, through the second fabric portion, and to the fourth fabric portion.

4. The biosensing garment of claim 2, wherein an absolute value of the first compression rating is between 5 mmHg and 9.9 mmHg, an absolute value of the second compression rating is less than 5 mmHg, an absolute value of the third compression rating is less than 5 mmHg, and an absolute value of the fourth compression rating is 4.4 mmHg or less.

5. The biosensing garment of claim 2, wherein a ratio of the first compression rating to the second compression rating is about 3 and a ratio of the first compression rating to the third compressing rating is about 3.

6. The biosensing shirt of claim 1, wherein the first fabric portion and the second fabric portion are tubular.

7. The biosensing shirt of claim 1, wherein the first fabric portion and the second fabric portion are formed seamlessly.

8. The biosensing shirt of claim 1, wherein the sensor assembly is integrally knitted into the first fabric portion.

9. The biosensing garment of claim 1, wherein an absolute value of the first compression rating is 2.7 mmHg to 9.9 mmHg.

10. The biosensing garment of claim 1, wherein an absolute value of the second compression rating is 4.5 mmHg to 7.7 mmHg.

11. The biosensing garment of claim 1, wherein an absolute value of the first compression rating is between 5 mmHg and 9.9 mmHg, an absolute value of the second compression rating is less than 5 mmHg, and an absolute value of the third compression rating is less than 5 mmHg.

12. The biosensing garment of claim 1, wherein an absolute value of the second compression rating is equal to an absolute value of the third compression rating.

13. The biosensing garment of claim 1, wherein a ratio of the first compression rating to the second compression rating is about 3.

14. The biosensing garment of claim 1, wherein a ratio of the first compression rating to the second compression rating is about 3 and a ratio of the first compressing rating to the third compressing rating is about 3.

* * * * *